US006879795B2

(12) United States Patent
Ohashi et al.

(10) Patent No.: US 6,879,795 B2
(45) Date of Patent: Apr. 12, 2005

(54) PHOTOCONDUCTIVE ELEMENT UNIT INCLUDING SUPPORT PORTIONS CONFIGURED TO ADJUST ECCENTRICITY POSITIONS FOR AN IMAGE FORMING APPARATUS

(75) Inventors: Michihito Ohashi, Yokohama (JP); Kohji Amanai, Kawasaki (JP); Tetsuya Nakao, Tokyo (JP); Hideaki Sugata, Kawasaki (JP); Toshio Shimazaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/384,593

(22) Filed: Mar. 11, 2003

(65) Prior Publication Data

US 2003/0180072 A1 Sep. 25, 2003

(30) Foreign Application Priority Data

Mar. 11, 2002 (JP) ..... 2002-065251
Jun. 11, 2002 (JP) ..... 2002-170250

(51) Int. Cl.[7] ..... G03G 15/00
(52) U.S. Cl. ..... 399/167
(58) Field of Search ..... 399/167, 107, 399/110

(56) References Cited

U.S. PATENT DOCUMENTS

| | | | | |
|---|---|---|---|---|
| 4,776,715 | A | 10/1988 | Takada et al. | |
| 4,794,420 | A | 12/1988 | Ohashi et al. | |
| 4,796,037 | A | 1/1989 | Takada et al. | |
| 4,796,050 | A * | 1/1989 | Furuta et al. | 399/167 |
| 4,835,565 | A | 5/1989 | Nagatsuna et al. | |
| 4,939,550 | A | 7/1990 | Takada et al. | |
| 4,970,552 | A | 11/1990 | Okamoto et al. | |
| 5,052,090 | A | 10/1991 | Kitaura et al. | |
| 5,280,362 | A | 1/1994 | Noguchi et al. | |
| 5,479,262 | A | 12/1995 | Namiki et al. | |
| 5,497,225 | A | 3/1996 | Matsuzuki | |
| 5,508,794 | A | 4/1996 | Ikesue et al. | |
| 5,545,381 | A | 8/1996 | Iida et al. | |
| 5,612,766 | A | 3/1997 | Iida et al. | |
| 5,867,759 | A | 2/1999 | Isobe et al. | |
| 5,970,286 | A * | 10/1999 | Numazu et al. | 399/167 |
| RE37,197 | E | 5/2001 | Iida et al. | |
| 6,360,070 | B1 * | 3/2002 | Taka et al. | 399/301 |
| 6,408,157 | B1 * | 6/2002 | Tanaka et al. | 399/301 |
| 6,507,713 | B2 * | 1/2003 | Koide | 399/51 |
| 2001/0028810 | A1 | 10/2001 | Yamaguchi et al. | |

FOREIGN PATENT DOCUMENTS

| | | | |
|---|---|---|---|
| EP | 0 895 132 | 2/1999 | |
| JP | 6-90561 | 11/1994 | |
| JP | 7-140753 | 6/1995 | |
| JP | 9-114168 | 5/1997 | |
| JP | 9-166898 | 6/1997 | |
| JP | 9-304944 | 11/1997 | |
| JP | 10-142932 | 5/1998 | |
| JP | 10-339976 | 12/1998 | |
| JP | 11-24356 | 1/1999 | |
| JP | 11-65367 | 3/1999 | |
| JP | 2000-56623 | 2/2000 | |
| JP | 2001-249523 | 9/2001 | |
| JP | 2001-272834 | 10/2001 | |
| JP | 2002318480 A * | 10/2002 | G03G/15/01 |

* cited by examiner

*Primary Examiner*—Quana Grainger
(74) *Attorney, Agent, or Firm*—Oblon, Spivak, McClelland, Maier & Neustadt, P.C.

(57) ABSTRACT

In an image forming apparatus of the present invention including a plurality of photoconductive drums arranged side by side, each photoconductive drum is configured to allow its opposite end portions in the main scanning direction to be adjusted in maximum eccentricity position in the direction of rotation independently of each other. The maximum eccentricity positions of the drums are capable of being matched in phase to each other in the direction of rotation at each of opposite end portions.

36 Claims, 22 Drawing Sheets

PHOTOCONDUCTIVE ELEMENT UNIT INCLUDING SUPPORT PORTIONS CONFIGURED TO ADJUST ECCENTRICITY POSITIONS FOR AN IMAGE FORMING APPARATUS

BACKGROUND OF THE INVENTION

1. Field of the Invention

The present invention relates to a copier, printer, facsimile apparatus or similar electrophotographic image forming apparatus and more particularly to a tandem color image forming apparatus including a plurality of photoconductive elements arranged side by side and each being rotatably supported at opposite end portions in the main scanning direction.

2. Description of the Background Art

A tandem color image forming apparatus, for example, includes a plurality of photoconductive drums or elements respectively assigned to a plurality of different colors, e.g., yellow, magenta, cyan and yellow and a plurality of optical writing devices respectively assigned to the drums. A laser beam issuing from each writing device and representative of a document image is focused on the surface of the drum associated therewith. A problem with the writing device is that when the surface of the drum on which the laser beam is focused is shifted in the direction of depth, the scanning position on the drum is also shifted in the main scanning direction. As a result, when images of different colors formed on the drums are superposed on each other, the colors are shifted from each other. The shift of the focusing position is ascribable to the oscillation and eccentricity of the drum in the radial direction.

In light of the above, Japanese Patent Laid-Open Publication Nos. 6-250474 and 2001-249523, for example, each teach that to make the shifts of a plurality of color images superposed on each other inconspicuous, vertical lines at each ends of an image in the direction perpendicular to the direction of sheet conveyance are matched to each other as to the phase of waving. However, even this kind of scheme is not fully satisfactory.

Technologies relating to the present invention are also disclosed in, e.g., Japanese Patent Publication No. 6-90561 (=Japanese Patent Laid-Open Publication No. 62-178988) and Japanese Patent Laid-Open Publication No. 7-140753.

SUMMARY OF THE INVENTION

It is an object of the present invention to provide a color image forming apparatus capable of obviating conspicuous color shifts in the main scanning direction when images of different colors are superposed on each other, and a photoconductive element unit for the same.

In accordance with the present invention, in an image forming apparatus including a plurality of photoconductive elements arranged side by side, each photoconductive element is configured to allow its opposite end portions in the main scanning direction to be adjusted in maximum eccentricity position in the direction of rotation independently of each other. The maximum eccentricity positions of the photoconductive elements are capable of being matched in phase to each other in the direction of rotation at each of opposite end portions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
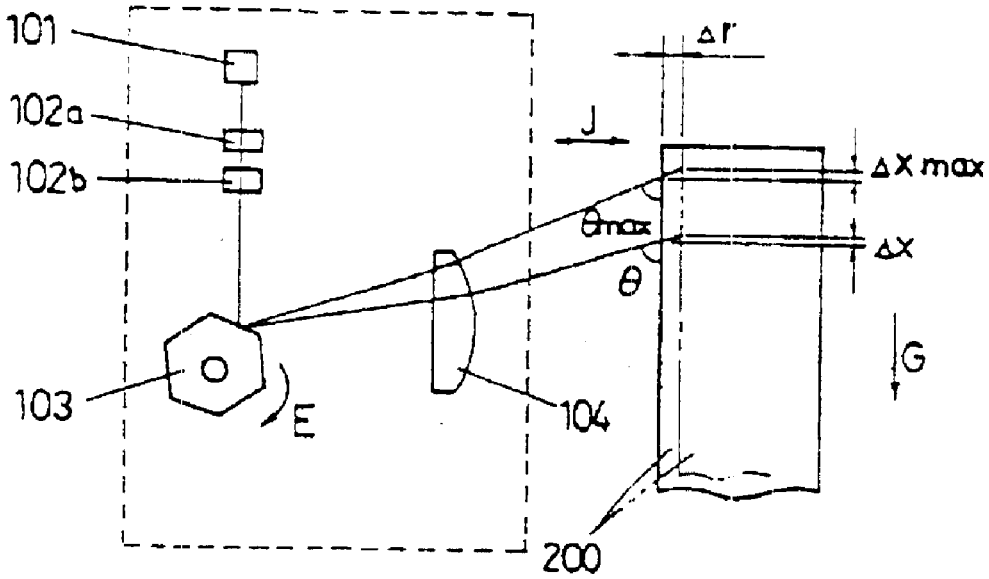
FIG. 1 PRIOR ART
FIG. 1 is a plan view showing a specific configuration of a conventional laser writing device.

To better understand the present invention, the problems of the conventional technologies will be described more specifically hereinafter. FIG. 1 shows a laser writing device which is a specific form of an optical writing device included in an electrophotographic image forming apparatus. As shown, a laser beam issuing from a laser diode 101 is incident to a polygonal mirror 103 via a collimator lens 102*a* and a cylindrical lens 102*b*. The laser beam steered by the polygonal mirror 103 is focussed on the surface of a photoconductive drum or element 200 via an f-θ lens 104. The polygonal mirror 103 is rotated in a direction indicated by an arrow E in FIG. 1, causing the laser beam to scan the drum 200 in a direction indicated by an arrow G.

Assume that the laser writing device described above is applied to a tandem color image forming apparatus including a plurality of photoconductive drums. Then, as shown in FIG. 1, when the surface of the drum 200 on which the laser beam is focused is shifted in the direction of depth indicated by an arrow J in FIG. 1, the scanning position on the drum 200 is also shifted in the main scanning direction, i.e., the up-and-down direction in FIG. 1, as stated earlier.

More specifically, assume that the angle between the surface of the drum 200 and the laser beam is θ, and that the drum 200 is shifted by a distance of Δr in the direction of depth. Then, the shift Δx of the scanning position on the surface of the drum 200 in the main scanning direction is expressed as:

$$\Delta x = \Delta r / (\tan \theta) \qquad \text{Eq. (1)}$$

As FIG. 1 indicates, the shift Δx has the maximum value Δxmax at the end portion of the drum 200. At a position where the angle θ is 90°, the shift Δx is zero even when the scanning position or focus position on the drum 200 is shifted.

Figure 2:
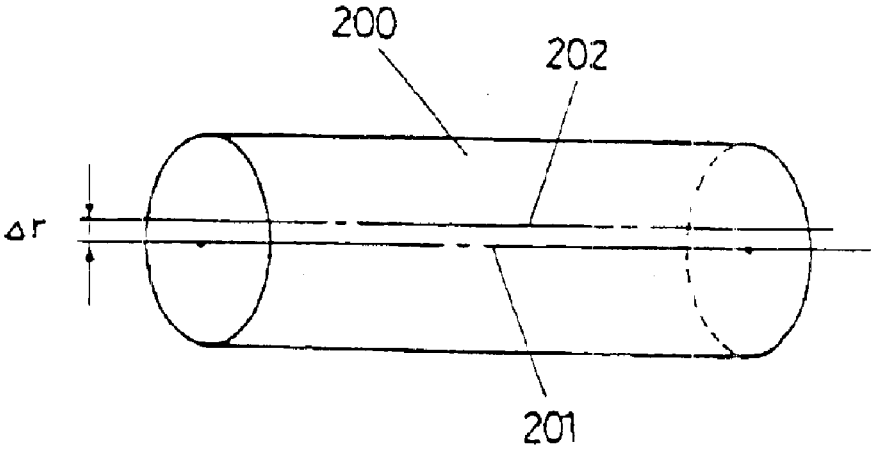
FIG. 2 PRIOR ART
FIG. 2 is a perspective view showing a specific condition wherein the actual axis of a photoconductive drum or element is shifted from an ideal axis in parallel to the ideal axis.
Figure 3:
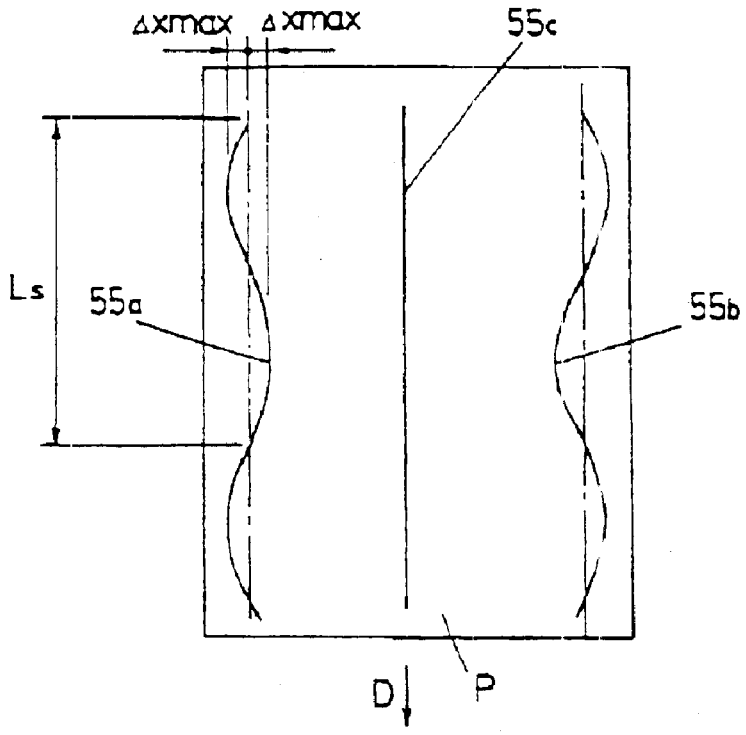
FIG. 3 PRIOR ART
FIG. 3 is a plan view showing how vertical line images wave on a sheet in the condition of FIG. 2.

The shift Δx is ascribable to the oscillation and eccentricity of the drum 200 in the radial direction, as stated previously. Specifically, as shown in FIG. 2, assume a case wherein the drum 200 has an axis 202 shifted from an ideal axis 201 free from eccentricity by Δr in parallel in the radial direction. Then, as shown in FIG. 3, a right and a left vertical line image 55*b* and 55*a* formed on a sheet P appear in the form of symmetrical waves at a period corresponding to the circumferential length Ls of the drum 200. In FIG. 3, the sheet P is conveyed in a direction indicated by an arrow D. A vertical line 55*c* is representative of a line image free from waving.

Figure 4:
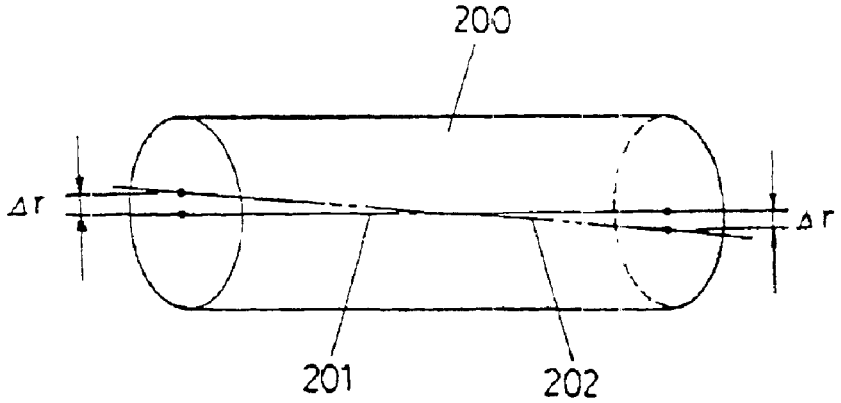
FIG. 4 PRIOR ART
FIG. 4 is a perspective view showing another specific condition wherein the actual axis of the photoconductive drum is shifted from the ideal axis in such a manner as to cross the ideal axis.
Figure 5:
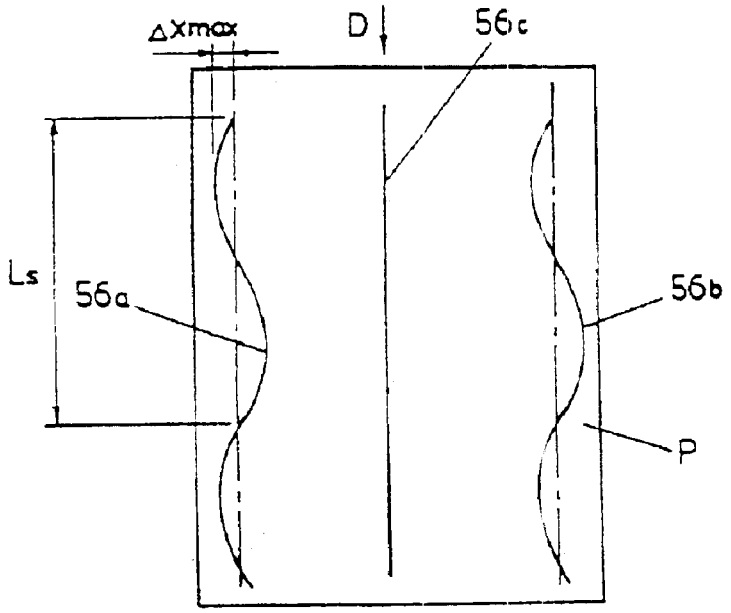
FIG. 5 PRIOR ART
FIG. 5 is a plan view showing how vertical line images wave on a sheet in the condition of FIG. 4.

On the other hand, as shown in FIG. 4, assume that the actual axis 202 of the drum 200 is shifted from the ideal axis 201 in such a manner as to cross the ideal axis 201. Then, as shown in FIG. 5, a right and a left vertical line image 56*b* and 56*a* formed on the sheet P wave in parallel to each other at the period corresponding to the circumferential length Ls of the drum 200. A vertical line 56*c* is representative of a line image free from waving.

Assume that the shift of the axis 202 of the drum 200 in each of FIGS. 2 and 4 is Δr. Then, the maximum shift Δxmax of an image to appear at opposite ends is produced by:

$$\Delta x\max = \Delta r / (\tan \theta \max) \qquad \text{Eq. (2)}$$

where θmax denotes the angle between the surface of the drum 200 and the laser beam at each end portion of the drum 200.

Usually, the oscillation and eccentricity of a photoconductive drum is confined in a preselected accuracy range Δrmax. In the tandem image forming apparatus, when the eccentricity of each drum is Δrmax, the phase of waving ascribable to the eccentricity Δrmax is sometimes inverted. It follows that the maximum shift of an image, which depends on the mounting accuracy of each drum, is expressed as:

$$\Delta x\max=2\times\Delta r\max/(\tan\theta\max) \quad \text{Eq. (3)}$$

In light of the above, to make the shifts of a plurality of color images superposed on each other inconspicuous, vertical lines at each end of an image in the direction perpendicular to the direction of sheet conveyance may be matched to each other as to the phase of waving. This scheme is taught in, e.g., Japanese Patent Laid-Open Publication Nos. 6-250474 and 2001-249523. However, such a scheme is effective only when the actual axis of the drum 200 is shifted from the ideal axis in parallel to the ideal axis, as shown in FIG. 2.

Figure 6:
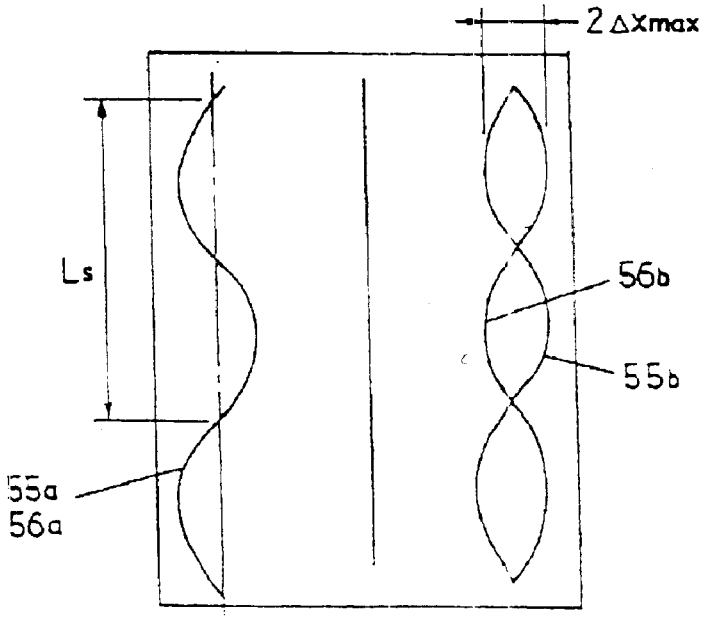
FIG. 6 PRIOR ART
FIG. 6 is a plan view demonstrating why conspicuous color shifts occur in the condition of FIG. 4.

More specifically, assume that the scheme stated above is applied to the case of FIG. 4 wherein the actual axis crosses the ideal axis. Then, as shown in FIG. 6, although the vertical lines 55*a* and 56*a* at one end subjected to phase matching are shifted little, the vertical lines 55*b* and 56*b* at the other end are shifted by the maximum amount of 2×Δxmax.

To obviate the maximum shift of 2×Δxmax, it is necessary to make the actual axis of the drum 200 parallel to the ideal axis. Usually, in a drum unit in which bearing portions or drive transmitting portions positioned at axially opposite ends of a drum are removable from the drum, it is necessary to determine the direction of eccentricity of the rear drive transmitting portion and then match the phase of the eccentricity position of the front side in the direction of rotation to the above direction of eccentricity.

However, even if a mark indicative of the maximum eccentricity position is provided on the rear drive transmitting portion, the mark is positioned at the rear side of the apparatus, which is dark, and therefore difficult to see. Toner, for example, deposited on the mark would make it more difficult to see the mark. It follows that it is extremely difficult with the conventional arrangement to match the directions of eccentricity at both ends of the drum in order to make the actual axis of the drum parallel to the ideal axis.

Figure 7:
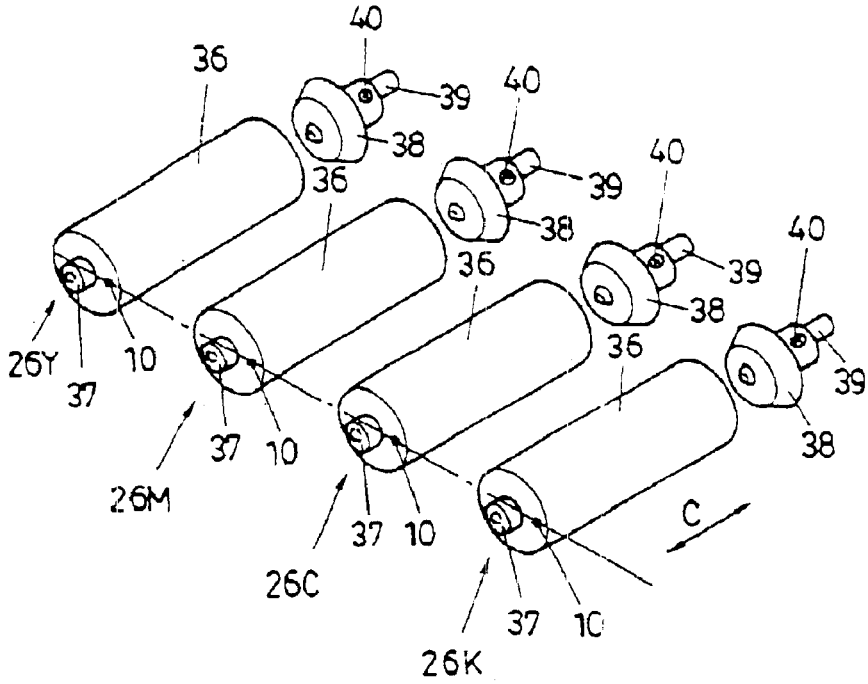
FIG. 7 is an exploded isometric view showing a plurality of photoconductive drums or elements included in a tandem color image forming apparatus embodying the present invention.
Figure 8A:
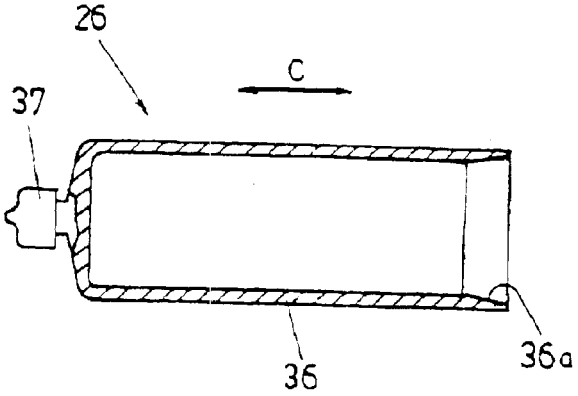
FIGS. 8A and 8B are exploded views showing one of the drums shown in FIG. 7.
Figure 8B:
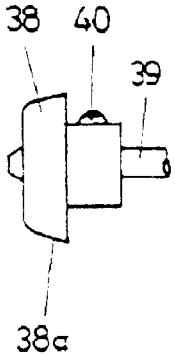
Figure 9:
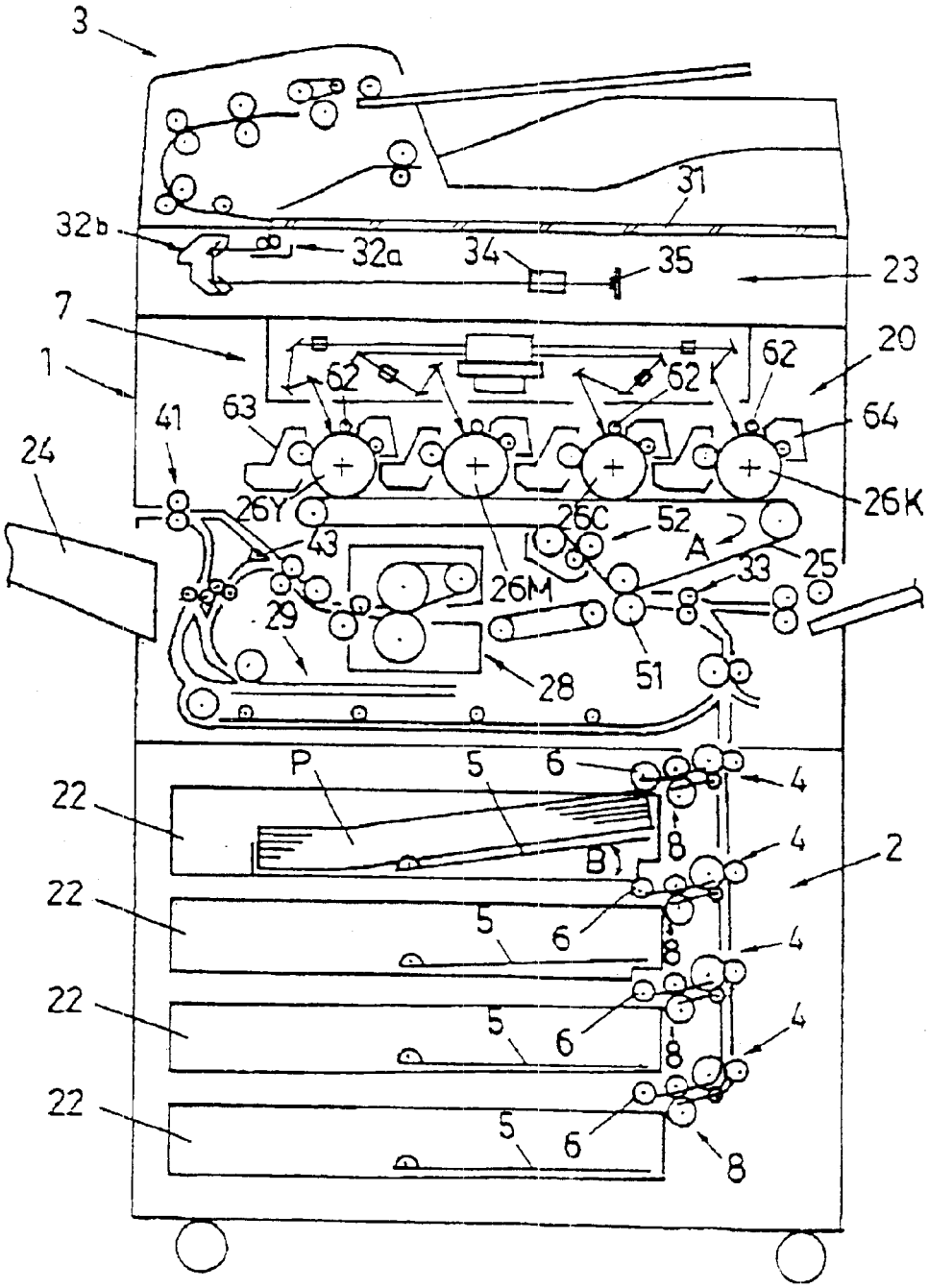
FIG. 9 is a view showing the general construction of the illustrative embodiment.

Referring to FIGS. 7 through 9, an image forming apparatus embodying the present invention and implemented as a color image forming apparatus by way of example will be described hereinafter. As shown in FIG. 9, the color image forming apparatus includes an apparatus body 1 and an image forming section (printer hereinafter) 20 in which four photoconductive drums or elements 26Y, 26M, 26C and 26K are arranged side by side at substantially the center of the apparatus body 1. A sheet feeding section 2 is positioned below the printer 20 and includes a plurality of sheet trays 22 each being loaded with a stack of sheets of particular size. An extra sheet bank, not shown, may be connected to the sheet feeding section 2, if desired.

A document reading section (scanner hereinafter) 23 is positioned above the printer 20 while a print tray 24 is positioned at the left-hand side of the printer 20, as viewed in FIG. 9. Sheets or prints P carrying images thereon are sequentially stacked on the print tray 24.

The printer 20 includes an intermediate image transfer belt (simply belt hereinafter) 25 passed over a plurality of rollers and movable in a direction indicated by an arrow A in FIG. 9. The drums 26Y through 26K are arranged side by side along the upper run of the belt 25.

Arranged around each of the drums 26Y through 26K are a charger 62, a developing unit 63, and a cleaning unit 64. The charger 62 uniformly charges the surface of the associated drum. The developing unit 63 develops a latent image formed on the associated drum with toner to thereby produce a corresponding toner image. After the toner image has been transferred from the drum to the belt 25, the cleaning device 64 removes toner left on the drum.

An optical writing unit 7 is arranged in the upper portion of the printer 20 and scans the charged surface of each drum with a particular laser beam in accordance with image data, thereby forming a latent image.

A registration roller pair 33 and a fixing unit 28 are respectively positioned upstream and downstream of the printer 20 in the direction of sheet conveyance. The registration roller pair 33 corrects the skew of the sheet P and then conveys it in synchronism with the rotation of the drums. The fixing unit 28 fixes a toner image transferred to the sheet P. An outlet roller pair 41 is positioned downstream of the fixing unit 28 in the direction of sheet conveyance in order to discharge the sheet P coming out of the fixing unit 28 to the print tray 24.

In FIG. 9, the reference numeral 3 designates an ADF (Automatic Document Feeder) for automatically conveying documents to a glass platen 31 one by one.

The operation of the color image forming apparatus will be described hereinafter. In a full-color mode, the chargers 62 each uniformly charge the surface of associated one of the drums 26Y through 26K. The writing unit 7 scans the charged surface of each of the drums 26Y through 26K with a particular laser beam in accordance with one of Y (yellow), M (magenta), C (cyan) and K (black) image data, thereby forming a latent image.

More specifically, in the scanner 23, carriages 32*a* and 32*b* loaded with a light source and mirrors are moved back and forth in the right-and-left direction, as viewed in FIG. 9, reading a document laid on the glass platen 31. The resulting reflection from the document is focused on a CCD (Charge Coupled Device) image sensor 35 via a lens 34. The CCD image sensor 35 photoelectrically transduces the incident light to a corresponding image signal. The image signal is subjected to various kinds of image processing including digitization. The resulting image data are sent to the writing unit 7. A laser beam issuing from a particular laser diode included in the writing unit 7 scans the charged surface of each drum 26 via a polygonal mirror and lenses, not shown, thereby forming a latent image.

Latent images thus formed on the four drums 26Y through 26K are developed by the four developing units 63, which store Y, M, C and K toners therein, respectively. As a result, a Y to a K toner image are formed on the drums 26Y to 26K, respectively. First, the Y toner image is transferred from the drum 26Y to the belt 25 moving in the direction A. When the Y toner image on the belt 25 arrives at the drum 26M, the M toner image is transferred from the drum 26M to the belt 25 over the Y toner image. Such a sequence is repeated to transfer the C and K toner images to the belt 25 over the composite image existing on the belt 25, thereby completing a full-color image.

When the full-color image on the belt 25 arrives at an image transfer position where an image transfer roller 51 is located, the image transfer roller 51 transfers the full-color image from the belt 25 to the sheet P. In this manner, a single full-color image is produced when the belt 25 makes one turn. After the image transfer, a belt cleaning unit 52 removes the toner left on the belt 25.

In a simplex printer mode, the sheet P coming out of the fixing unit 28 is driven out of the apparatus body 1 to the print tray 24 by the outlet roller pair 41. In a duplex print mode, a path selector 43 positioned on a path between the fixing unit 28 and the outlet roller pair 41 steers the sheet P toward a duplex print unit 29 located below the printer 20. The duplex print unit 29 turns the sheet P and again conveys it to the printer 29 via the registration roller pair 33. As a result, another full-color image is transferred to the other side of the sheet P. This two-sided sheet or print P is driven out to the print tray 24 via the outlet roller pair 41.

In the sheet feeding section 2, sheet feeding devices 4 each are assigned to respective one of the sheet trays 22. The sheet feeding devices 4 each include a bottom plate or stacking means 5 loaded with a stack of sheets P, a pickup roller or pay-out means 6, and separating means 8. The pickup roller 6 is rotatable counterclockwise, as viewed in FIG. 9, for paying out the top sheet from the associated bottom plate 5. The separating means 8 includes a feed roller and a reverse roller cooperating to separate the sheets P underlying the top sheet P from the top sheet P.

The drums 26Y through 26K are identical in configuration except for the color of toner and will be simply labeled 26 hereinafter. In the illustrative embodiment, opposite end portions of each drum 26 in the main scanning direction are adjustable in the direction of rotation independently of each other. More specifically, as shown in FIGS. 8A and 8B, the drum 26 includes a tubular core or element body 36 produced by impact molding. A bearing or support portion 37 is press-fitted in one end of the core 36 in the main scanning direction or axial direction indicated by an arrow C. The other end of the core 36 has its inner periphery configured as a tapered portion 36*a*. A flange or another support portion 38 is formed of resin and received in the tapered portion 36*a*. The flange 38 is fastened to a drive shaft 39 by a screw 40 while the drive shaft 39 is driven by a motor not shown. In this configuration, the portions of the drum 26 corresponding to the bearing 37 and drive shaft 39 are rotatably supported.

A spring, not shown, constantly biases the tubular core 36 and bearing 37 to the right, as viewed in FIGS. 8A and 8B, so that the tapered portion 36*a* of the core 36 remains in close contact with the tapered surface 38*a* of the flange 38. The core 36 is therefore held integrally with the flange 38. In this condition, the flange 38 rotates integrally with the core 36 and bearing 37 when the drive shaft 39 is driven by the motor. In this manner, the flange 38 is separable from the core 36. The bearing 37 may also be configured to be separable from the core 36, if desired.

In the event of assembly of the separable drum 26, the bearing 37 and flange 38 are respectively matched to the other bearings 37 and flanges 38 in the phase of the maximum eccentricity position in the direction of rotation. Thereafter, the bearing 37 and 38 are affixed to the core 36, so that the drums 26 all are matched as to the phase of the maximum eccentricity position when mounted to the apparatus body 1.

Figure 10:
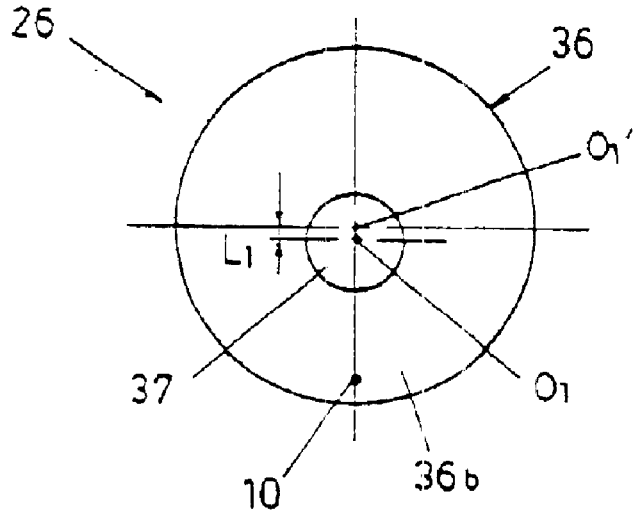
FIG. 10 is a side elevation showing the drum in a specific condition wherein the axis of a bearing is shifted from an ideal axis in the radial direction.

More specifically, the eccentricity of the bearing 37, which is mounted on the front end of the core 36, is measured before the drum 26 is mounted to the apparatus body 1. As shown in FIG. 10, assume that the actual axis $O_1$ of the bearing 37 is shifted from the ideal or zero-eccentricity axis $O_1'$ by $L_1$ at the maximum eccentricity position in the radial direction of the core 36. Then, a mark 10 indicative of the maximum eccentricity position is put on the end face 36*b* of the core 36 in the direction of eccentricity.

Figure 11:
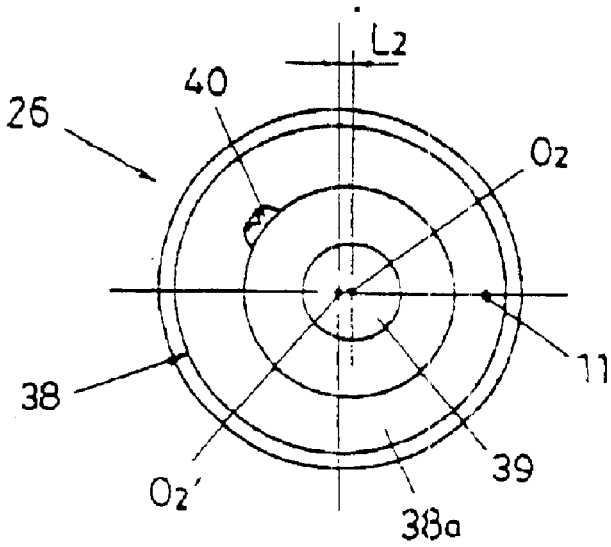
FIG. 11 is a side elevation showing the drum in another specific condition wherein the axis of a flange is shifted from an ideal axis in the radial direction.

Likewise, the eccentricity of the flange 38, which is mounted on the rear end of the core 36 is measured before the drum 26 is mounted to the apparatus body 1. As shown in FIG. 11, assume that the actual axis $O_2$ of the flange 38 is shifted from the ideal or zero-eccentricity axis $O_2'$ by $L_2$ at the maximum eccentricity position in the radial direction of the core 36. Then, a mark 11 indicative of the maximum eccentricity position is put on the end face 38*a* of the flange 38 in the direction of eccentricity.

Figure 12:
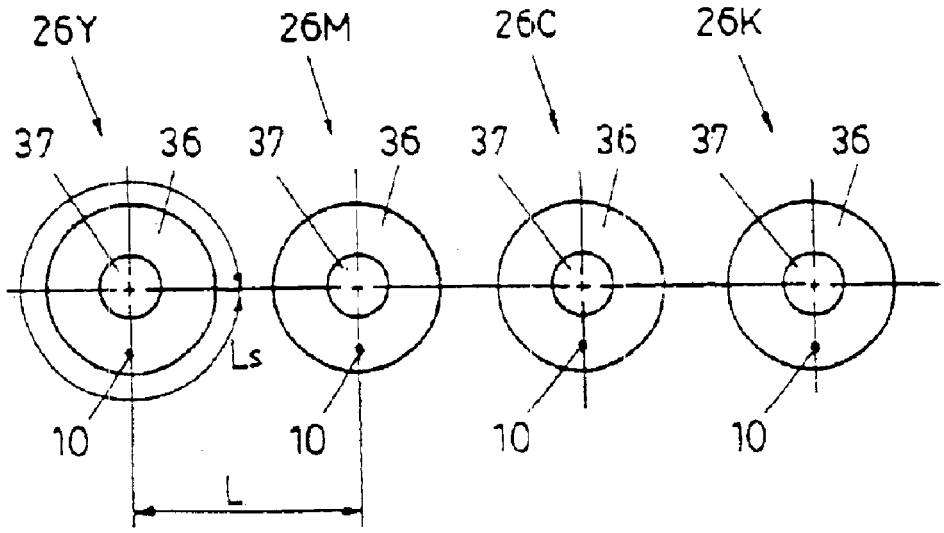
FIG. 12 shows marks put on the end faces of the drums adjoining the bearings and matched in phase in the direction of rotation.
Figure 13:
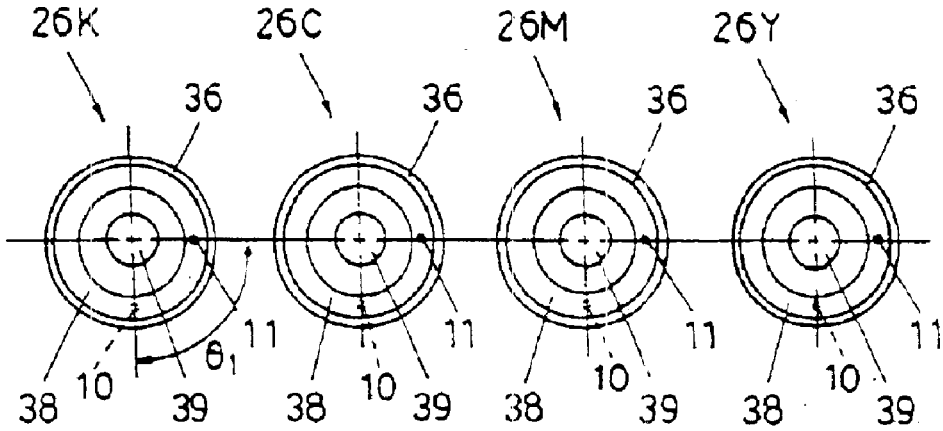
FIG. 13 shows marks put on the end faces of the flanges positioned at the opposite side to the bearings and matched in phase in the direction of rotation.

Subsequently, as shown in FIG. 7, the phases of the marks 10 put on the end faces 36*b* of the cores 36 are matched in the direction of rotation. Thereafter, as shown in FIG. 13, the flanges 38 are affixed to the respective cores 36 with their marks 11 being matched in phase in the direction of rotation. More specifically, as shown in FIG. 12, the cores 36 with the bearings 37 fitted therein are positioned such that their marks 10 are oriented, e.g., vertically downward. Subsequently, as shown in FIG. 13, the flanges 38 are positioned such that their marks 11 all are oriented, e.g., horizontally to the right.

After the mark 10 of the core 36 and the mark 11 of the flange 38 have been positioned at an angle $\theta_1$ relative to each other in the direction of rotation, the flange 38 joined with the drive shaft 39 and core 36 are affixed to each other. This completes any one of the drums 26Y through 26K.

Subsequently, the drums 26Y through 26K are mounted to the apparatus body 1, FIG. 9, with their marks 10 being matched to each other in the direction of rotation. Consequently, as shown in FIG. 13, the marks 11 of all of the flanges 38 are also matched in phase to each other in the direction of rotation.

In the above condition, the drums 26Y through 26K all are connected to respective drum drive portions which are directly driven by a single motor without the intermediary of clutches. The motor therefore causes all of the drums 26Y through 26K to rotate in interlocked relation to each other in the same phase in the direction of rotation. The output torque of the above motor may additionally be transferred to rotatable units other than the drums 26Y through 26K, e.g., the belt 25, if desired.

Figure 14:
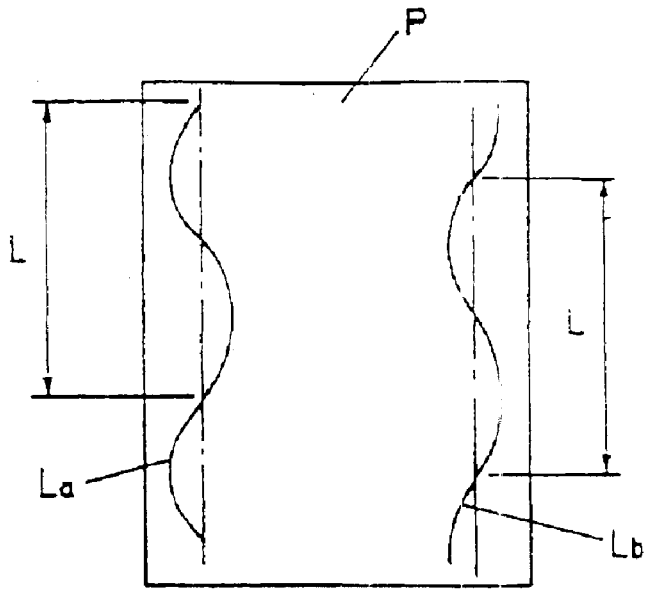
FIG. 14 is a plan view showing a right and a left vertical line image formed on a sheet by use of the drums matched in phase in the direction of rotation as to each of the opposite marks.

As shown in FIG. 12, assume that the distance L between nearby drums 26 is coincident with the circumferential length Ls of each drum 26. Then, if the marks 10 put on the end faces 36*b* of the cores 36 are matched in phase in the direction of rotation and if the marks 11 put on the flanges 38 are matched in phase in the direction of rotation, even a full-color image is free from color shifts even if each mark 10 and associated mark 11 are not matched in phase to each other. More specifically, as shown in FIG. 14, only if the above two conditions are satisfied, the phases of waving of different colors are coincident on a left vertical line La and so are the phases of waving of different colors on a right vertical light Lb although the right and left waves are not coincident in phase.

Assume that the distance L between nearby drums 26 shown in FIG. 12 is not coincident with the circumferential length Ls of each drum 26. Then, the marks 10 and 11 each should only be shifted in the direction of rotation such that the vertical lines La and Lb wave as shown in FIG. 14. This frees a full-color image from color shifts without resorting to the work for matching the marks 10 in phase in the direction of rotation or matching the marks 11 in phase in the same direction.

Figure 15:
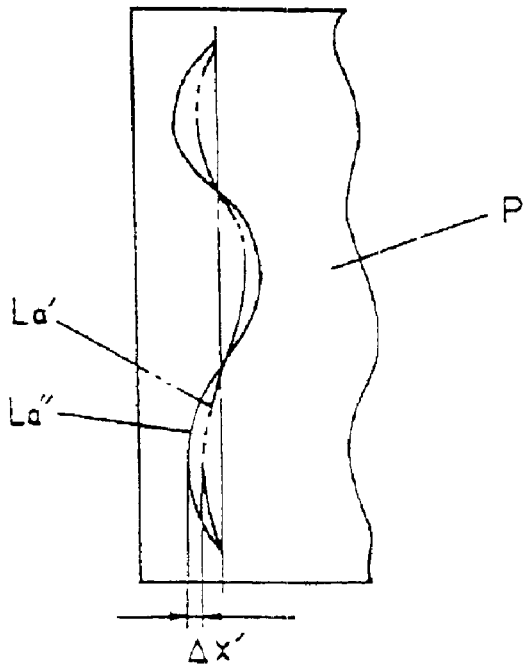
FIG. 15 is a plan view for describing why a color shift does not matter at all despite a difference in eccentricity between the drums only if the maximum eccentricity positions of the drums are matched in phase to each other in the direction of rotation.

Further, even if the eccentricity at the maximum eccentricity position is different between the drums 26Y through 26K, such a difference does not matter at all if the phases of the maximum eccentricity positions are matched to each other in the direction of rotation. More specifically, assume that the maximum eccentricity position of the drum 26M and that of the drum 26K differ from each other by $\Delta r'$. Then, as shown in FIG. 15, only if vertical lines La' and La" formed by the drums 26M and 26K, respectively, are coincident in phase, then a positional shift Δx' is produced by:

$$\Delta x'max=\Delta r'max/(\tan\theta) \quad \text{Eq. (4)}$$

where θ denotes an angle between the surface of each of the drums 26M and 26K and the laser beam issuing from the writing unit 7, FIG. 9, and incident to the drum. The angle θ is generally selected to be around −70°. Today, however, the angle θ is decreasing in parallel with the decrease in the size of the writing unit 7. Considering such a trend, the positional shift or color shift Δx' may be produced from the Eqs. (3) and (4) by assuming θ=60°, Δrc=ΔrM=ΔrY=0.07 mm and Δr'k=0.02 mm, as follows:

$$\Delta xmax=0.081 \text{ mm (without phase matching)}$$

$$\Delta xmax=\Delta x'=0.029 \text{ (with phase matching}$$

A document KONIKA TECHNICAL REPORT VOL. 13 (2000), page 61 teaches that the positional shift or color shift Δx' that cannot be recognized by eye is about 50 μm. Therefore, only if the maximum eccentricity positions of the drums 26 are matched in phase in the direction of rotation, any color shift will not be conspicuous to eye so long as the positional shift Δx' ascribable to the difference Δr' is 50 μm or less.

Figure 16:
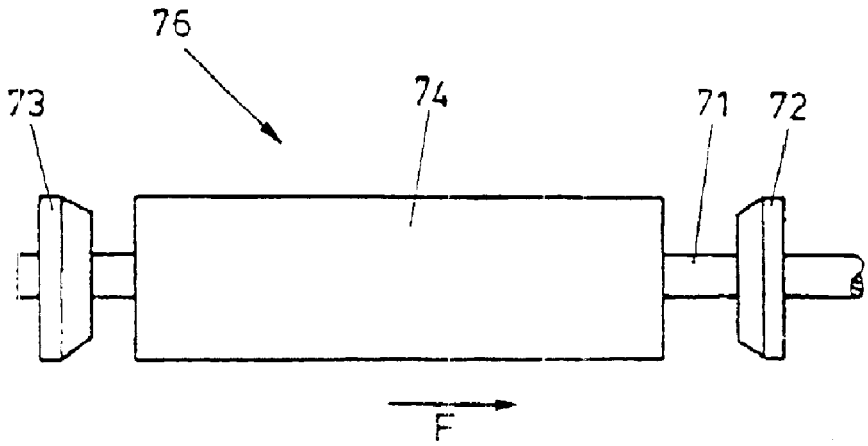
FIG. 16 is a front view showing a specific configuration of the drum having a core implemented as a machined pipe and flanges removably fitted in the core.

While the tubular core 36 has been shown and describing as being produced by impact molding, it may be implemented by a pipe only if the bearing or the flange is press-fitted or adhered to one end of the pipe. Specifically, FIG. 16 shows a drum 76 including a tubular core 74 implemented by a machined pipe and flanges or support portions 72 and 73 formed of resin. A shaft 71 is positioned at the centers of the flanges 72 and 73. More specifically, after the flange 72 has been press-fitted or otherwise affixed to the shaft 71, the pipe 74 is coupled over the shaft 71 in a direction indicated by an arrow F until it abuts against the flange 72. Subsequently, the flange 73 is fitted in the left end of the pipe 74 in the direction F. In this condition, a spring, not shown, is caused to press the flange 73 in the direction F for thereby affixing the shaft 71, flanges 72 and 73 and pipe 74 to each other.

In the configuration shown in FIG. 16, what has the most critical influence on eccentricity is the dimensional accuracy of the front and rear flanges 73 and 72. More specifically, as for a drum provided with flanges at opposite ends thereof, a shaft or torque transmitting member is generally machined by a lathe and therefore has eccentricity as small as 0.03 mm or less. However, each flange is, in many cases, formed of resin and cannot have the accuracy of its eccentricity increased to more than about 0.08 mm. Therefore., the accuracy of the two flanges has noticeable influence on eccentricity as to the color shift of a color image in the main scanning direction described with reference to FIG. 15, which corresponds to the positional shift Δx'.

Figure 17:
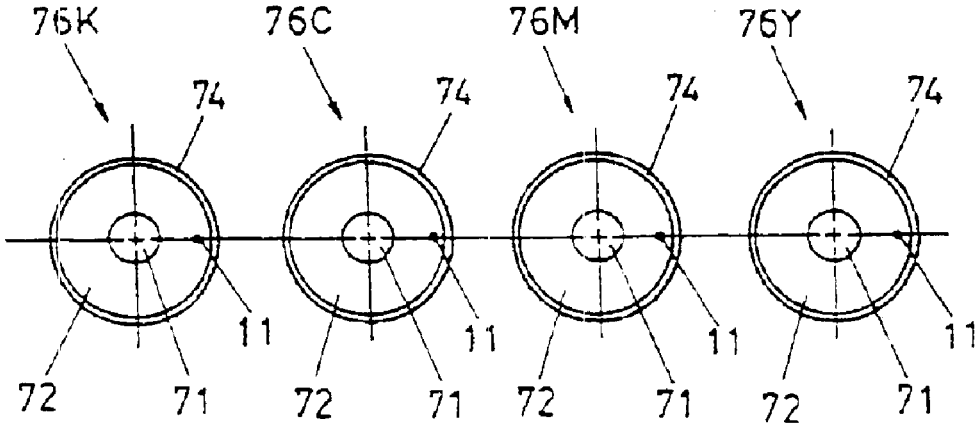
FIG. 17 shows the drums each having the configuration of FIG. 16 with marks put on the end faces of rear flanges being matched in phase to each other in the direction of rotation.
Figure 18:
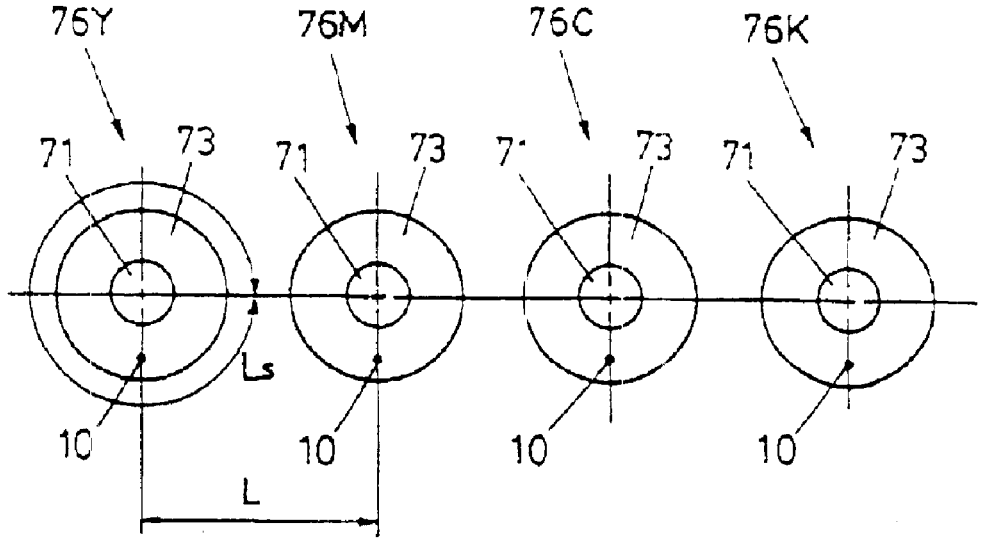
FIG. 18 is a view similar to FIG. 17, showing the drums arranged with marks put on the end faces of front flanges being matched in phase to each other in the direction of rotation.

In light of the above, as shown in FIG. 17, the rear flange 72 of each drum 76 shown in FIG. 16 has its eccentricity measured first. Subsequently, the mark 11 indicative of the maximum eccentricity position is put on the end face of the flange 72. Likewise, the eccentricity of the front flange 73 is measured, and then the mark 10 indicative of the maximum eccentricity position is put on the end face of the flange 73, as shown in FIG. 18. After the shaft 71 has been press-fitted or other wise affixed to the flange 72, the pipe 74 is joined with the flange 72. Subsequently, as shown in FIG. 17, the flanges 72 of the pipes 74 are positioned such that their marks 11 are matched in phase to each other in the direction of rotation. Thereafter, as shown in FIG. 18, the other flanges 73 are fitted in the respective pipes 74 36 with their marks 10 being matched in phase in the direction of rotation. After this step, a spring, not shown, presses the flange 73 in the direction F, FIG. 16, to thereby affix the shaft 71, flanges 72 and 73 and pipe 74 to each other. Consequently, as shown in FIG. 17, when the drums 26 are mounted to the apparatus body 1, FIG. 9, the marks 11 on the flanges 72 all are matched in phase in the direction of rotation. At the same time, as shown in FIG. 18, the marks 10 on the other flanges 73 all are matched in phase to each other in the direction of rotation.

Each of the flanges 72 and 73 may have its maximum eccentricity position measured alone. It is, however, more preferable from the accuracy standpoint to press-fit the shaft 71 in the flanges 72 and 73 for thereby positioning the shaft 71 at the centers of the flanges 72 and 73, and then measure the maximum eccentricity positions of the flanges 72 and 73 relative to the axis of the shaft 71.

Again, assume that the distance L between nearby drums 26 is coincident with the circumferential length Ls of each drum 26. Then, if the marks 11 put on the flanges 72 are matched in phase in the direction of rotation and if the marks 10 put on the flanges 73 are matched in phase in the direction of rotation, even a full-color image is free from color shifts even if the each mark 10 and associated mark 11 are not matched in phase to each other. This frees a full-color image from color shifts without resorting to the work for matching the maximum eccentricity positions of the flanges 72 and 73 to each other when mounting the flanges 72 and 73 to the pipe 73.

Figure 19:
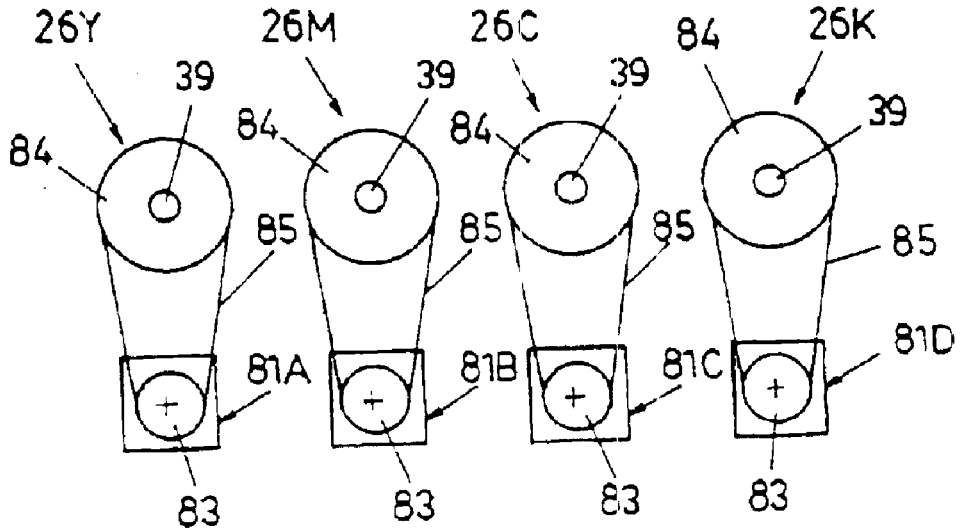
FIG. 19 shows a specific configuration of a printer section included in the image forming apparatus in which each drum is driven by a respective motor.

FIG. 19 shows a printer section included in a color image forming apparatus of the type driving each photoconductive drive with a particular motor. In FIG. 19, structural elements identical with the structural elements shown in FIGS. 8A, 8B and 12 are designated by identical reference numerals. As shown, the image forming apparatus includes motors 81A, 81B, 81C and 81D respectively assigned to the drums 26Y, 26M, 26C and 26K (only the drive shafts 39 are shown for simplicity).

A timing pulley 83 is mounted on the output shaft of each of the motors 81A through 91D while a timing pulley 84 is mounted on each of the drive shafts 39. A timing belt 85 is passed over the timing pulleys 83 and 84 associated with each other. In this configuration, the motors 81A through 81D respectively drive the drums 26Y through 26K via the associated timing pulleys 83, timing belts 85 and timing pulleys 84 independently of each other.

Figure 20:
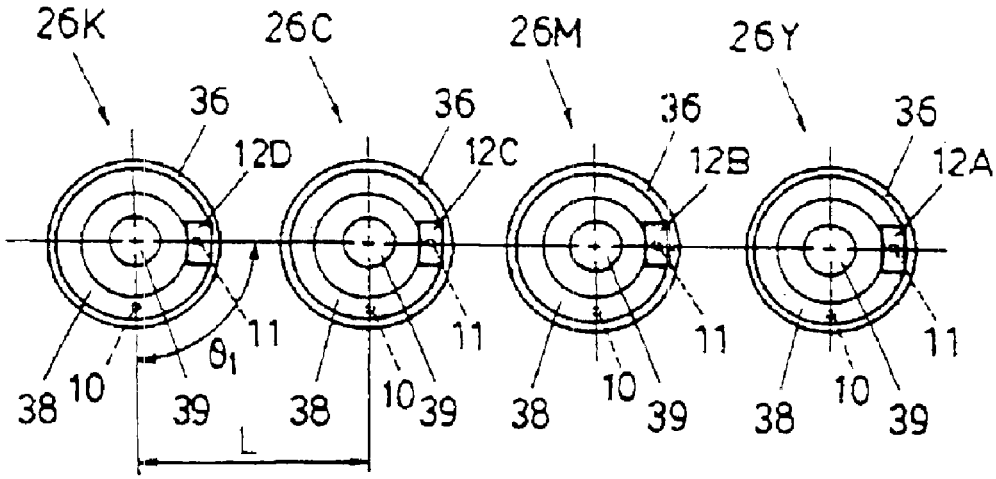
FIG. 20 shows sensors responsive to the marks and included in the printer section of FIG. 19.

As shown in FIG. 20, the printer section additionally includes sensors 12A, 12B, 12C and 12D responsive to the marks 11 put on, e.g., the flanges 38 of the drums 26Y, 26M, 26C and 26K, respectively. The sensors or maximum eccentricity position sensing means 12A through 12K are located at the same position in the direction of rotation of the drums 26Y through 26K. As shown in FIG. 20, in the full-color mode, the marks 11 are matched in position in the direction of rotation on the basis of the outputs of the sensors 12A through 12D.

Of course, the sensors 12A through 12D may be adjoin the bearings 37 of the drums 26A through 26K so as to sense the marks 10, FIG. 12, thereby matching the maximum eccentricity positions of the drums 26A through 26K. While the sensors 12A through 12D are implemented as reflection type photosensors in this specific configuration, any other sensors may be used so long as they can sense the marks 11 (or the marks 10).

In operation, in the full-color mode, the drums 26Y through 26K are rotated before the start of image formation.

As soon as the sensors 12A through 12D each sense the mark 11 of the rear flange 38 of the associated drum 26, the drum 26 is brought to a stop. As a result, the drums 26 all are matched in phase in the direction of rotation because the marks 10 and 11 each are matched in phase when the drums 26 are mounted on the apparatus body and because the angle $\theta_1$, FIG. 13, between the marks 10 and 11 associated with each other does not vary. This successfully obviates the color shift of a full-color image.

In the illustrative embodiment, in a black mode (or sometimes in a magenta or a cyan mode), the drums and drivelines that do not contribute to image formation can be held in a halt. This obviates wasteful toner consumption and protects the drums from fatigue. The drum driven in the black or any other monochromatic mode is shifted in the phase of the maximum eccentricity position and would therefore bring about a positional shift in the main scanning direction if driven in a bicolor, tricolor or full-color mode later. Such a positional shift can be obviated because the maximum eccentricity positions of all of the drums 26Y through 26K are matched before image formation, as stated earlier. Again, if the distance L between nearby drums 26 is coincident with the circumferential length Ls of each drum 26, then a full-color image is free from color shifts.

Figure 21:
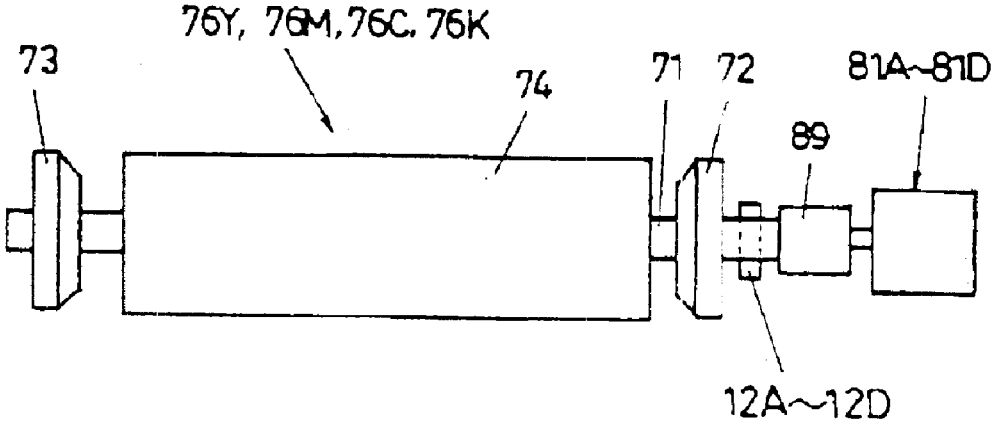
FIG. 21 is a view similar to FIG. 16, showing another specific configuration of the drum applicable to the construction of FIG. 19.

FIG. 21, which is similar to FIG. 16, shows another specific configuration of one of the drums 76Y through 76K included in the configuration of FIG. 19. In FIG. 21, structural elements identical with the structural elements shown in FIG. 16 are designated by identical reference numerals. As shown, the shaft 71 of the drum 76Y is connected to the output shaft of the motor 81A via a shaft joint 89 at its rear end adjoining the flange 72. Likewise, the shaft 71 of the drum 76M is connected to the output shaft of the motor 81B via a shaft joint 89 at its end. Further, the shafts of the drums 76C and 76K are respectively connected to the output shafts of the motors 81C and 81D via shaft joints 89 at their rear ends. The sensors 12A through 12B responsive to the marks 11 on the flanges 72 are located at the same position as each other in the direction of rotation of the drums 76Y through 76K. With this configuration, too, it is possible to match the maximum eccentricity positions of all of the drums 76Y through 76K as to phase, as described with reference to FIG. 20.

Figure 22:
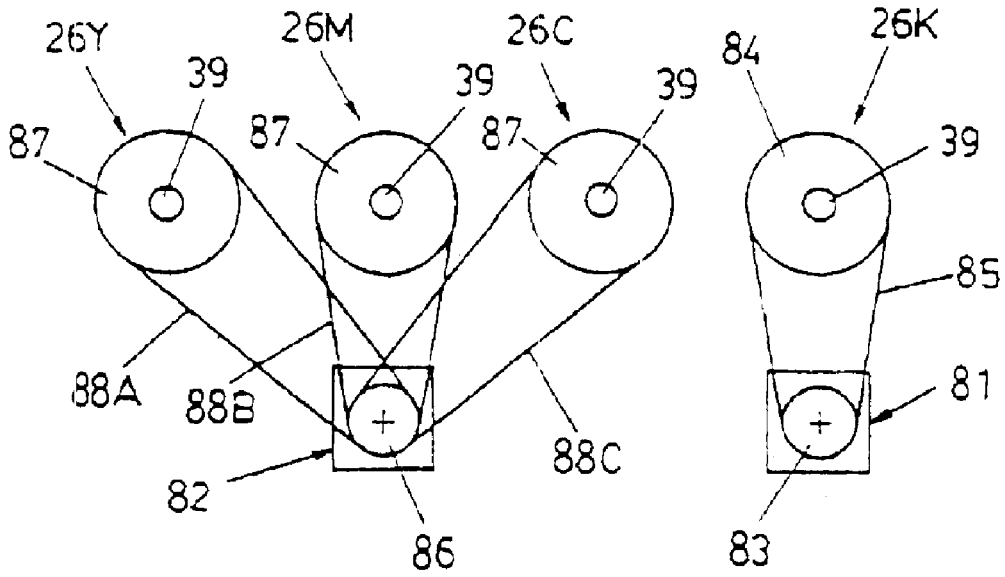
FIG. 22 shows another specific configuration of the printer section including a single exclusive motor assigned to one drum and a single shared drum assigned to the other drums.

FIG. 22 shows another specific configuration of the printer section in which one motor drives one of a plurality of drums while another motor drives the other drums. In FIG. 22, structural elements identical with the structural elements shown in FIGS. 8A, 8B and 12 are designated by identical reference numerals. Generally, in a color mode, image forming sections inclusive of drums assigned to all of the colors Y through K should be driven while, in a black mode, only the image forming section including the drum assigned to black should be driven. Further, because the life of each image forming section is proportional to the duration of drive, holding the Y, M and C image forming sections inoperative in the black mode is successful to extend the life of the Y, M and C image forming sections, thereby reducing the frequency of maintenance.

In light of the above, in this specific configuration, one motor 81 drives, among the drums 26Y through 26K each having the configuration of FIGS. 8A and 8B and arranged as shown in FIG. 22, only the drum 26K while another motor 82 drives the other drums 26Y through 26K. More specifically, as shown in FIG. 22, a timing belt 85 is passed over the timing pulleys 83 and 84 mounted on the output shaft of the motor 81 and drive shaft 39 of the drum 26K, respectively. The motor 81 therefore drives only the drum 26K via the above driveline.

Timing belts 88A, 88B and 88C are respectively passed over a timing pulley 86 mounted on the output shaft of the motor 82 and timing pulleys 87 mounted on the drive shafts 88A, 88B and 88C of the drums 26Y, 26M and 26C. In this condition, the motor 82 drives the drums 26Y through 26C at the same time via the timing belts 88A through 88C, respectively.

The drums 26Y through 26K each are configured such that the flange 38, FIGS. 8A and 8B, is separable from the tubular core or pipe 36. One of the drums 26Y through 26K whose flange 38 has the minimum eccentricity is implemented as the drum 26K to be driven by the motor 81. The other drums 26Y through 26C are driven by the other motor 82 and have their flanges 38 matched in the phase of the maximum eccentricity position in the direction of rotation and then mounted to the respective cores 36. As a result, the maximum eccentricity positions of the drums 26Y through 26C are matched in phase to each other in the direction of rotation.

More specifically, in the illustrative embodiment, the eccentricity of each bearing 37 (see FIG. 24) mounted on the front end of each drum 26 is measured before the drum 26 is mounted to the apparatus body. Subsequently, a mark 17 is put on any one of such drums 26 whose bearing 37 has eccentricity equal to or less than a preselected value $\Delta r$ of, e.g., 0.02 mm. The marks 10 are put on the end faces of the pipes 36 of the other drums 26 whose eccentricity exceeds the preselected value $\Delta r$.

Likewise, the eccentricity of each flange 38, FIG. 17, mounted on the rear end of each drum 26 is measured before the drum 26 is mounted to the apparatus body. Subsequently, a mark 16 is put on the drums 26 whose flanges 38 have eccentricity equal to or less than the preselected value $\Delta r$ of, e.g., 0.02 mm. The marks 11 are put on the end faces of the flanges 38 of the other drums 26 whose eccentricity exceeds the preselected value $\Delta r$.

Figure 23:
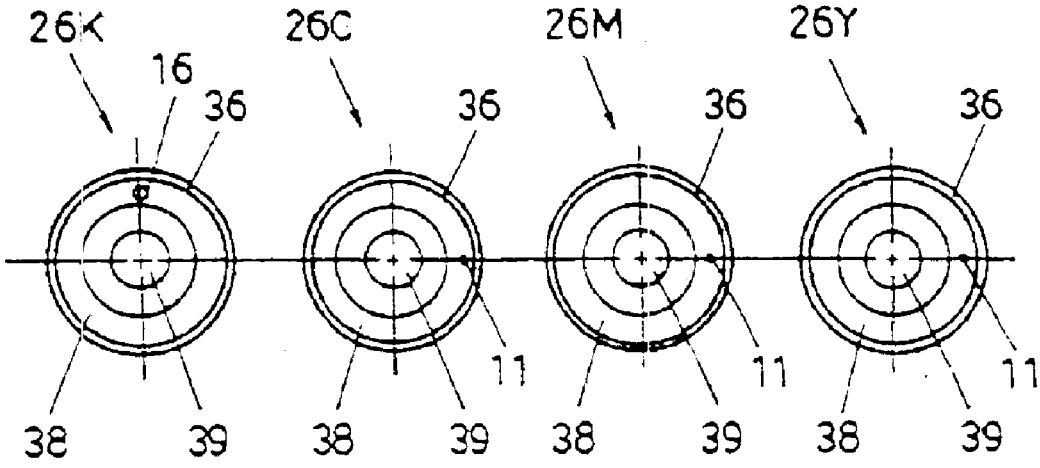
FIG. 23 shows three of the drums included in the configuration of FIG. 22 and having their marks matched in phase to each other.
Figure 24:
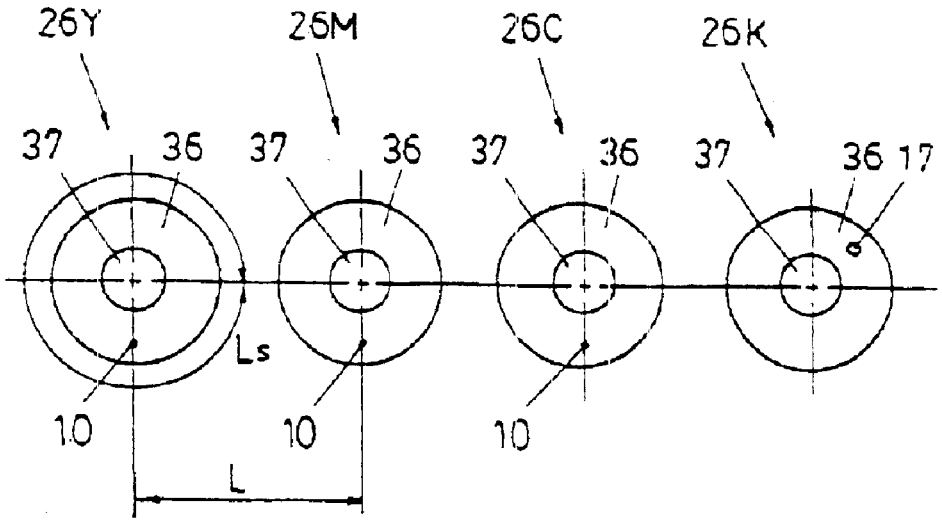
FIG. 24 shows two different kinds of marks applied to the configuration of FIG. 22.

The flange 38 with the mark 16 indicative of the small eccentricity is assigned to the drum 26K and mounted to the associated drive shaft 39. As shown in FIG. 23, the other flanges 38 with the marks are mounted to the respective drive shafts 39 with the marks 11 being matched in phase to each other in the direction of rotation. Subsequently, the pipe 36 with the bearing 37 fitted in one end thereof, as shown in FIG. 24, is affixed to each of the flanges 38. At this instant, the bearings 37 assigned to the drums 26Y through 26C have their marks 10 matched in phase in the direction of rotation.

The procedure described above allows the drums 26Y through 26C to be mounted to the apparatus body with all of the marks 10 put on the pipes 36 being matched in phase in the direction of rotation. At the same time, the marks 11 put on the flanges 38 all are matched in phase in the direction of rotation.

While the marks 10 of the drums 26Y through 26C and the mark 17 of the drum 26K do not have to be matched to each other in phase (angle $\theta_1$, FIG. 13), the former may, of course, be matched to the latter.

In FIG. 24, assume that the distance L between nearby drums 26 is coincident with the circumferential length Ls of each drum 26. Then, if the marks 10 of the pipes 36 of the drums 26Y through 26C are matched in phase and if the marks 11 of the flanges 11 are matched in phase, then even a full-color image is free from color shifts without each front mark 10 and associated rear mark 11 being necessarily matched in phase. Further, in the illustrative embodiment, the drum 26 with small eccentricity is assigned to the drum 26K for black, reducing the waving of the vertical lines described with reference to FIG. 14.

To calculate the shifts of vertical lines on a sheet, assume that the drum 26M for magenta has greater eccentricity than the drums 26Y and 26C. Assume that the drum 26M has eccentricity of ΔrM, that the drum 26K has eccentricity of ΔrK, and the maximum amount of waving of an M image and that of a K image ascribable to the above eccentricity are ΔxM and ΔxK, respectively. Then, the maximum amounts of waving ΔxM and ΔxK are produced by:

$$\Delta xM=\Delta rM/(\tan\theta) \quad \text{Eq. (5)}$$

$$\Delta xK=\Delta rK/(\tan\theta) \quad \text{Eq. (6)}$$

Figure 25:
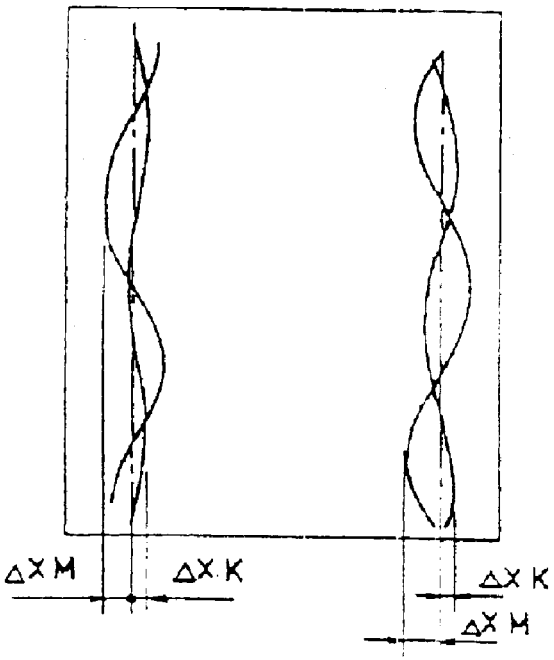
FIG. 25 is a plan view showing the degree of shift between magenta image and a black image formed on a sheet.

Further, assume that the angle θ between the surface of each of the drums 26M and 26K and the laser beam issuing from the writing unit and incident on the drum surface is 60°, which is derived from the size of the writing unit decreasing today, and that ΔrM and ΔrK are 0.07 mm and 0.02 mm, respectively. Then, the maximum color shift is derived from the Eqs. (5) and (6), as follows (see FIG. 25 also):

$$\Delta xM-K=\Delta xM+\Delta xK=0.052\ \text{mm}$$

A color shift that cannot be recognized by eye is about 50 μm, according to the previously stated document. In this sense, the configuration described above can reduce the color shift ΔxM−K, if any, to about 50 μm.

Figure 26:
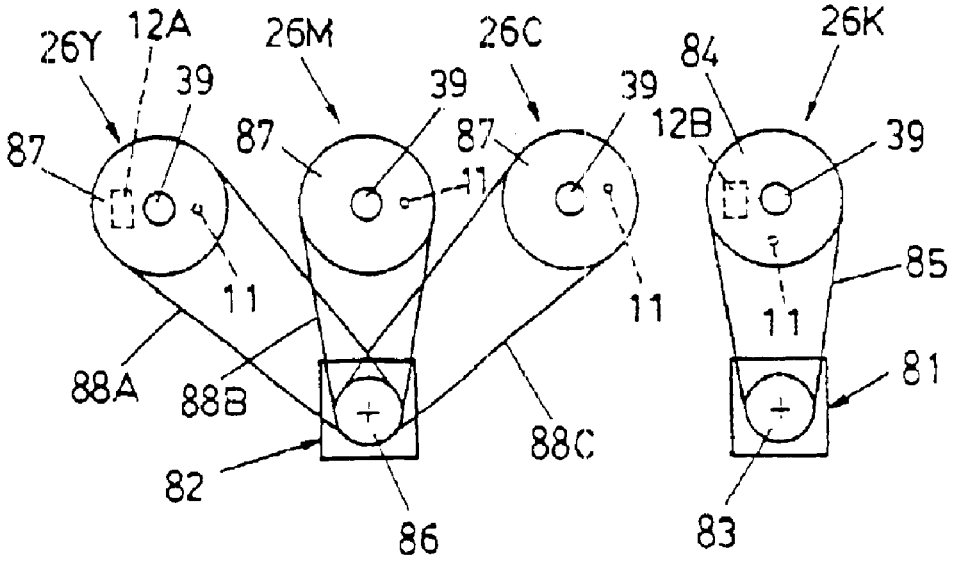
FIG. 26 shows another specific configuration of the printer section including a single exclusive motor assigned to one drum, a single shared motor assigned to the other drums, and sensors responsive to the marks indicative of the maximum eccentricity positions.

FIG. 26 shows another specific configuration of the printer section similar to the configuration of FIG. 22 except for the following. In FIG. 26, structural elements identical with the structural elements of FIG. 22 are designated by identical reference numerals. As shown, sensors or maximum eccentricity position sensing means 12B and 12A are assigned to the drums 26 Kand 26Y, respectively, and located at the same position in the direction of rotation of the drums. The sensor 12B is responsive to the mark 11 put on the flange 28, FIGS. 8A and 8B, of the drum 26K driven by a single motor 81. The sensor 12A is responsive to the mark 11 put on the flange 38 of one of the other drums 26Y, 26M and 26C driven by the other motor 82 (drum 26Y in the illustrative embodiment).

In the color mode using all of the drums 26Y through 26K, the motors 81 and 82 are driven before the start of image formation to thereby rotate the drums 26Y through 26K. As soon as the sensor 12A senses the mark 11 put on the drum 26Y, the motor 82 is turned off. Likewise, when the sensor 12B senses the mark 11 put on the drum 26K, the motor 81 is turned off. Consequently, the maximum eccentricity positions of the drums 26Y and 26K indicated by the marks 11 are matched to each other in the direction of rotation.

At the same time, the positions of the marks 10 and those of the marks 11 put on all of the drums 26Y through 26K are automatically matched to each other in the direction of rotation although the angle $\theta_1$, FIG. 13, does not have to be zero. This is because the marks 10 put on the drums 26Y, 26M and 26C at the bearing sides are matched beforehand and because the marks 11 on the flanges 38 are also matched beforehand.

As stated above, despite that the drums 26Y through 26K are driven by the two motors 81 and 82, color shifts in the color mode are obviated because the maximum eccentricity positions at one side indicated by the marks 10 and the maximum eccentricity positions at the other side indicated by the marks 11 are matched individually.

While a single sensor suffices for sensing the marks 11 of the drums 26Y, 26M and 26C, a particular sensor may be assigned to each of the drums 26Y, 26M and 26C. In the illustrative embodiment, as in the embodiment of FIG. 20, the distance L between nearby drums 26 is identical with the circumferential length Ls of each drum 26, so that color shifts in a full-color image are obviated.

Figure 27:
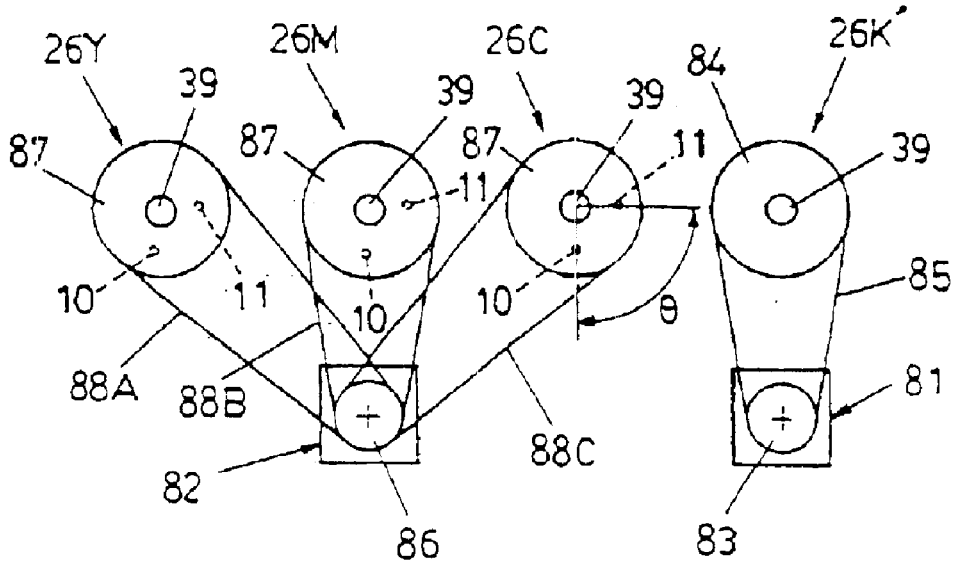
FIG. 27 shows another specific configuration of the printer section in which one drum with small eccentricity is driven by an exclusive motor while the other drums are driven by a shared drum.

FIG. 27 shows another specific configuration of the printer section similar to the configuration of FIG. 26 except for the following. In FIG. 27, structural elements identical with the structural elements of FIG. 26 are designated by identical reference numerals. As shown, the motor 81 drives, among a plurality of drums, a drum 26K' for black whose bearing 37, FIGS. 8A and 8B, and flange 38 both have small eccentricity. The other motor 82 drives the other drums 26Y, 26M and 26C. The drums 26Y, 26M and 26C are mounted to the apparatus body after the maximum eccentricity positions have been matched in phase in the direction of rotation at each of opposite sides of the drums.

In the illustrative embodiment, in the monochrome mode, only the drum 26K' is driven by the motor 81. This successfully reduces the fatigue of the motor 82 and reduces the wear of the bearings and other components of the other drums 26Y, 26M and 26C.

In the full-color mode, the drums 26Y through 26K' all are driven by the motors 81 and 82. At this instant, the maximum eccentricity positions of the drums 26Y, 26M and 26C indicated by the marks 10 and those indicated by the marks 11 matched to each other are prevented from being disturbed. This is because the drums 26Y, 26M and 26C are mounted on the apparatus body with their marks 10 and 11 matched at each side and because the drums 26Y, 26M and 26C are driven by a single motor 82. It follows that Y, M and C line images formed by the drums 26Y, 26M and 26C, respectively, on a sheet in the subscanning direction wave in the same phase at each of the right and left sides of the sheet and are therefore free from color shifts.

Further, vertical line images formed by the drum 26K' on the sheet in the subscanning direction wave little because the eccentricity of the drum 26K' is originally small at opposite sides. Therefore, even if the phase of waving of such vertical line images is not coincident with the phase of waving of the Y, M and C vertical line images, the difference is not recognized by eye.

In this specific configuration, as in the configuration of FIG. 20, the distance L between nearby drums 26 is coincident with the circumferential length Ls of each drum 26 for the purpose stated earlier.

Figure 28:
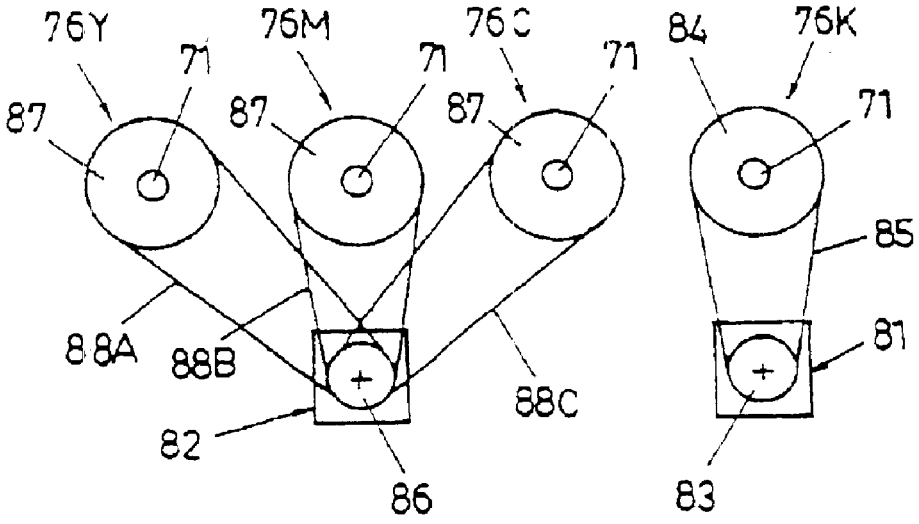
FIG. 28 is a view similar to FIG. 27, showing another specific configuration of the printer section in which the drums implemented by machined pipes are driven by two motors.

FIG. 28 shows another specific configuration of the printer section similar to the configuration of FIG. 27 except for the following. In FIG. 28, structural elements identical with the structural elements of FIG. 27 are designated by identical reference numerals. As shown, four drums are implemented by the drums 76Y through 76K each having the configuration described with reference to FIG. 16. The flanges 72 and 73 formed of resin are respectively fitted in the opposite ends of each machined pipe or core 74.

In this specific configuration, the dimensional accuracy of the flanges 72 and 73 formed of flange is a decisive factor relating to the eccentricity of the drum 76; color shifts occur in the main scanning direction, depending on the degree of eccentricity.

Figure 29:
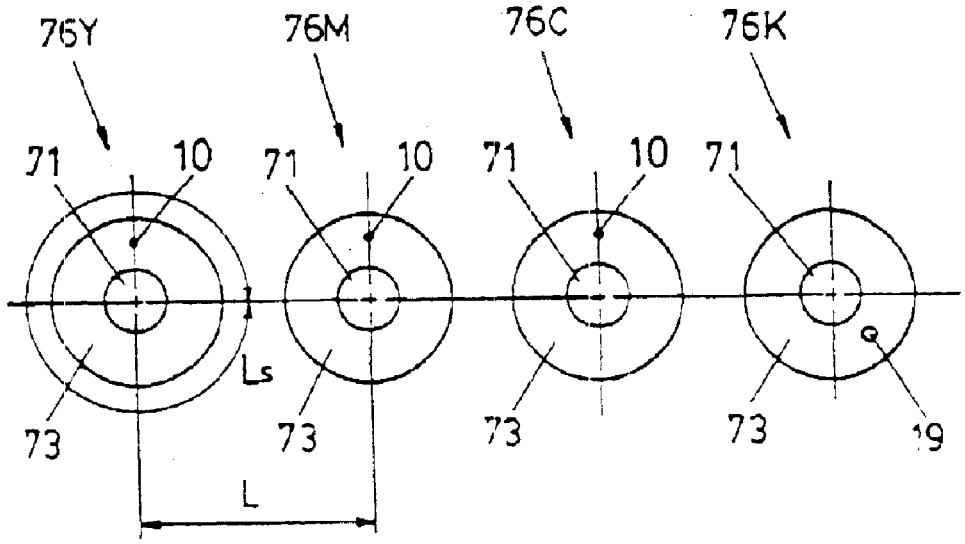
FIG. 29 shows the drums of FIG. 28 with marks put on the end faces of front flanges other the front flange of the drum assigned to black being matched in phase to each other.

In light of the above, the eccentricity of the front flange 73 is measured before each drum 76 is mounted to the apparatus body. As shown in FIG. 29, a mark 19 is put on the end face of the flange 73 of the drum 76 whose eccentricity is determined to be equal to or less than a preselected value Δr of, e.g., 0.02 mm. Also, the marks 10 are put, in the direction of eccentricity, on the end faces of the flanges 73 of the other drums 76 whose eccentricity is determined to be greater than the above preselected value Δr.

Figure 30:
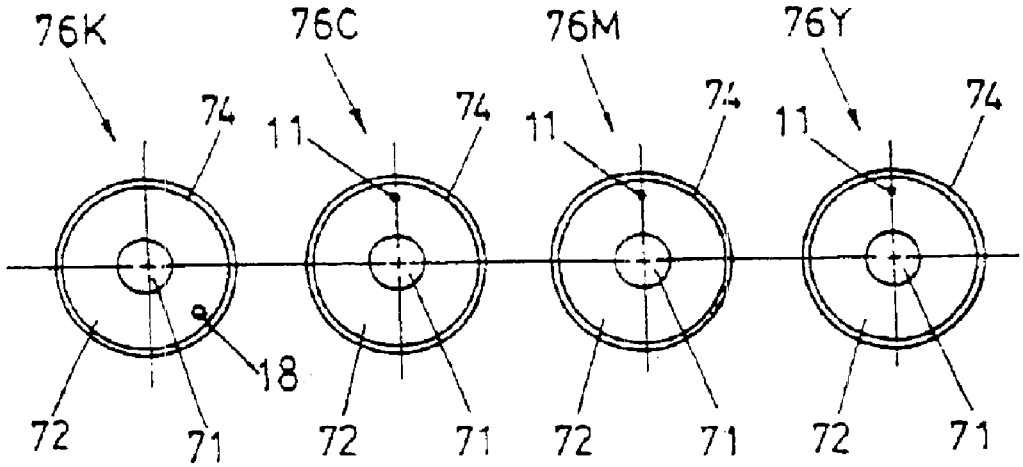
FIG. 30 shows the drums of FIG. 28 with marks put on the end faces of rear flanges other the front flange of the drum assigned to black being matched in phase to each other.

Likewise, the eccentricity of each rear flange 72 is measured before each drum 76 is mounted to the apparatus body. As shown in FIG. 30, a mark 18 is put on the end face of the flange 72 of the drum 76 whose eccentricity is determined to be equal to or less than the preselected value Δr. Also, the marks 11 are put, in the direction of eccentricity, on the end faces of the flanges 72 of the other drums 76 whose eccentricity is determined to be greater than the above preselected value Δr.

One of the rear flanges 72 with small eccentricity indicated by the mark 18 is mounted to the shaft 71 assigned to the black drum 76K. The other flanges 72 are mounted to the shafts 71 assigned to the other drums 76Y, 76M and 76C with their marks 11 matched in phase in the direction of rotation, as shown in FIG. 30. Subsequently, one of the front flanges 73 with small eccentricity indicated by the mark 19 is mounted to the shaft 71 assigned to the drum 76K. The other flanges 73 are mounted to the shafts 71 assigned to the other drums 76Y, 76M and 76C with their marks 10 matched in phase in the direction of rotation, as shown in FIG. 29.

The above procedure allows the drums 76Y, 76M and 76C to be mounted to the apparatus body with all of the marks 11 put on the flanges 72 being matched in phase in the direction of rotation. This is also true with the marks 10 put on the flanges 73. While the marks 10 of the drums 76Y, 76M and 76C and the mark 19 of the drum 76K do not have to be matched in phase to each other in the direction of rotation, they may, of course, be matched to each other.

Assume that the distance L between nearby drums 76 is coincident with the circumferential length Ls of each drum 76. Then, by matching the phases of the marks 10 put on the flanges 73 of the drums 76Y, 76M and 76C and matching the phases of the marks 11 put on the flanges 72, it is possible to free a full-color image from color shifts even if each mark 10 and associated mark 11 are not matched in phase in the direction of rotation.

The drum 76K originally has small eccentricity and therefore reduces the waving of vertical line images to a degree that cannot be recognized by eye.

Again, each of the flanges 72 and 73 may have its maximum eccentricity position measured alone. It is, however, more preferable from the accuracy standpoint to press-fit the shaft 71 with the flanges 72 and 73 for thereby positioning the shaft 71 at the centers of the flanges 72 and 73, and then measure the maximum eccentricity positions of the flanges 72 and 73 relative to the axis of the shaft 71.

Figure 31:
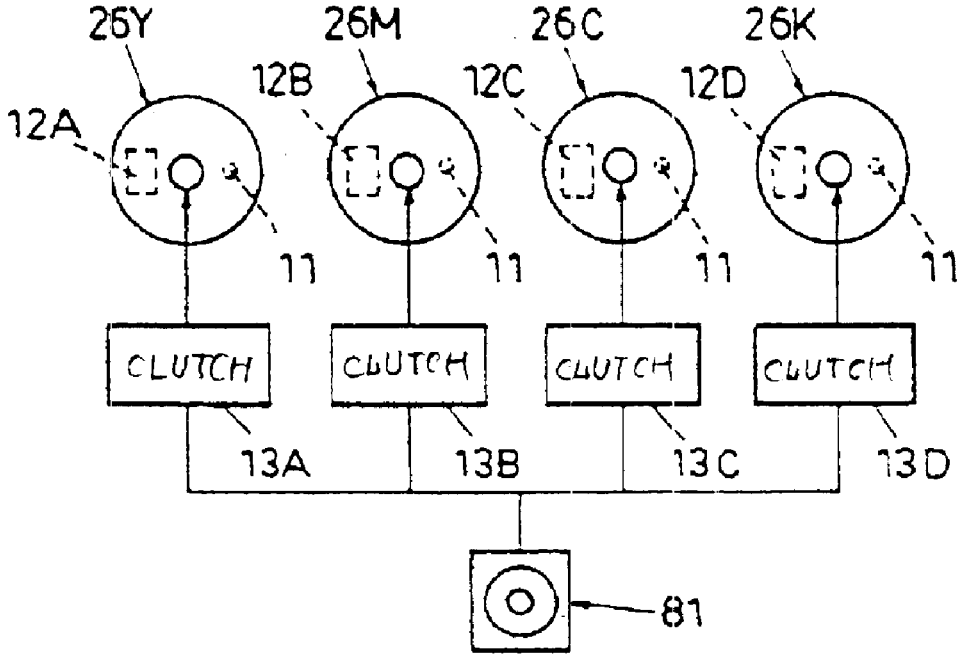
FIG. 31 shows a specific configuration of a drum driveline configured to transfer the output torque of a single motor to the drums via clutches.

FIG. 31 shows still another specific configuration of the printer section. In FIG. 31, structural elements identical with the structural elements of FIG. 19 are designated by identical reference numerals. As shown, a single motor 81 drives all of the four drums 26Y, 26M, 26C and 26K via clutches 13A, 13B, 13C and 13D, respectively. In this specific configuration, as in the configuration of FIG. 20, the sensors 12A through 12D are associated with the drums 26Y through 26K and located at the same position in the direction of rotation. The sensors 12A through 12D each sense the mark 11 put on the flange 38 (or the bearing 37 side) of one of the drums 26Y through 26K.

In the full-color mode, the motor 81 is driven to rotate the drums 26Y through 26K via the clutches 13A through 13D before the start of image formation. As soon as the sensors 12A through 12D respectively sense the marks 11 put on the flanges 38 of the drums 26Y through 26K, the clutches 13A through 13D are uncoupled to interrupt torque transmission from the motor 81 to the drums 26A through 26K. As a result, the maximum eccentricity positions of the drums 26Y through 26K indicated by the marks 11 are matched to each other in the direction of rotation. Further, the maximum eccentricity positions indicated by the marks 10 at the bearing 27 sides and those indicated by the marks 11 at the flange 28 side are identical as to the angle $\theta_1$, as stated with reference to FIG. 13. Consequently, the maximum eccentricity positions in the direction of rotation all are matched at each end of the drums 26, obviating color shifts.

This configuration reduces the cost of the apparatus because it uses a single motor 81 which is relatively expensive.

Figure 32:
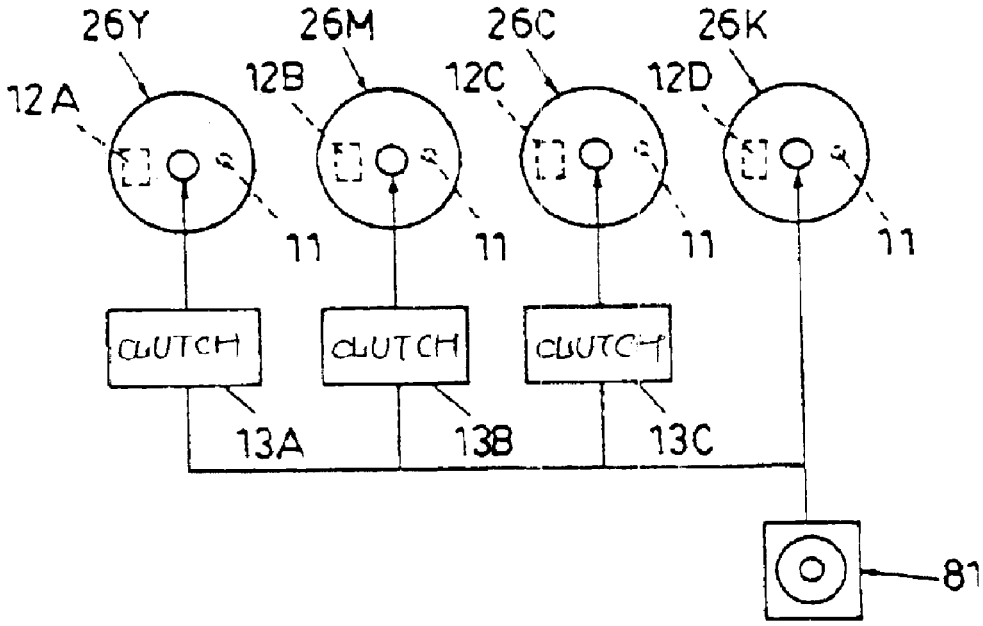
FIG. 32 shows another specific configuration of the drum driveline in which one motor directly drives one drum while driving the other drums via clutches.

FIG. 32 shows yet another specific configuration of the printer section similar to the configuration of FIG. 31 except for the following. In FIG. 31, structural elements identical with the structural elements of FIG. 31 are designated by identical reference numerals. As shown, a single motor 81 directly drives, e.g., the black drum 26K without the intermediary of the clutch 13. The output torque of the motor 81 is transferred to the other drums 26Y, 26M and 26C via the clutches 13A, 13B and 13C, respectively. Again, the sensors 12A through 12D responsive to the marks 11 put on the flanges 38 are assigned to the drums 26Y through 26K, respectively.

In the full-color mode, the motor 81 is driven before the start of image formation to thereby rotate the drums 26Y through 26K. When the sensor 12A senses the mark 11 of the drum 26Y, the clutch 13A is uncoupled to interrupt torque transmission from the motor 81 to the drum 26Y. Likewise, when the sensor 12B senses the mark 11 of the drum 26M, the clutch 13B is uncoupled. Further, when the sensor 12C senses the mark of the drum 26C, the clutch 13C is uncoupled. Subsequently, when the sensor 12D senses the mark 11 of the drum 26K, the motor 81 is turned off.

The above procedure matches all of the marks 11 of the drums 26Y through 26K indicative of the maximum eccentricity positions to each other in the direction of rotation. Also, the angle $\theta_1$ between the marks 10 and 11 is identical throughout the drums 26Y through 26K, so that the marks 10 of the drums 26Y through 26K are automatically matched in position to each other. It follows that the maximum eccentricity positions indicated by the marks 10 and 11 are matched at each side of the drums 26Y through 26K, obviating color shifts.

Figure 33:
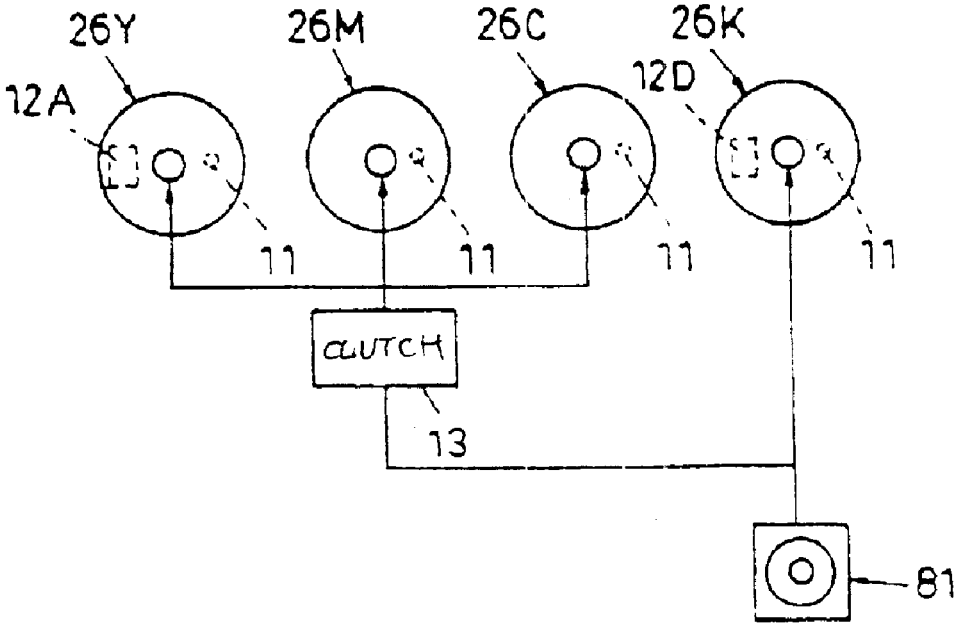
FIG. 33 shows another specific configuration of the drum driveline in which one motor directly drives one drum while driving the other drums via a single clutch.

FIG. 33 shows a further specific configuration of the printer section similar to the embodiment of FIG. 32 except for the following. In FIG. 33, structural elements identical with the structural elements of FIG. 32 are designated by identical reference numerals. As shown, a single motor 81 directly drives, e.g., the black drum 26K without the intermediary of the clutch 13. The output torque of the motor 81 is transferred to the other drums 26Y, 26M and 26C via a single clutch 13. The sensors 12A and 12D responsive to the marks 11 put on the flanges 38 are assigned to the drums 26Y and 26K, respectively.

In the full-color mode, the motor 81 is driven before the start of image formation to thereby rotate the drums 26Y through 26K. When the sensor 12A senses the mark 11 of the drum 26Y, the clutch 13 is uncoupled to interrupt torque transmission from the motor 81 to the drum 26Y. Likewise, when the sensor 12B senses the mark 11 of the drum 26M, the clutch 13B is uncoupled to thereby cause the drums 26Y, 26M and 26C to stop rotating. Subsequently, when the sensor 12D senses the mark. 11 of the drum 26K, the motor 81 is turned off.

The above procedure also matches all of the marks 11 of the drums 26Y through 26K indicative of the maximum eccentricity positions to each other in the direction of rotation. Also, the marks 10 put on the bearing sides of the drums 26Y, 26M and 26C are matched in position beforehand, and so are the marks 11 put on the flange sides, as stated with reference to FIG. 7 as well as other figures. In this condition, the drums 26Y through 26C are driven at the same time via the shared clutch 13. Further, the angle $\theta_1$ between the marks 10 and 11 is identical throughout the drums 26Y through 26K, so that the marks 10 of the drums 26Y through 26K as well as the marks 11 are automatically matched in position to each other. It follows that the maximum eccentricity positions indicated by the marks 10 and 11 are matched at each side of the drums 26Y through 26K, obviating color shifts.

If desired, a particular sensor may be assigned to each of the drums 26M and 26C.

In the configurations shown in FIGS. 32 and 33, it is preferable to directly drive the black drum 26K with a single motor 81. In this configuration, the clutch 13 is not operated in the blackmode, which is frequently used, and has its life extended.

Figure 34:
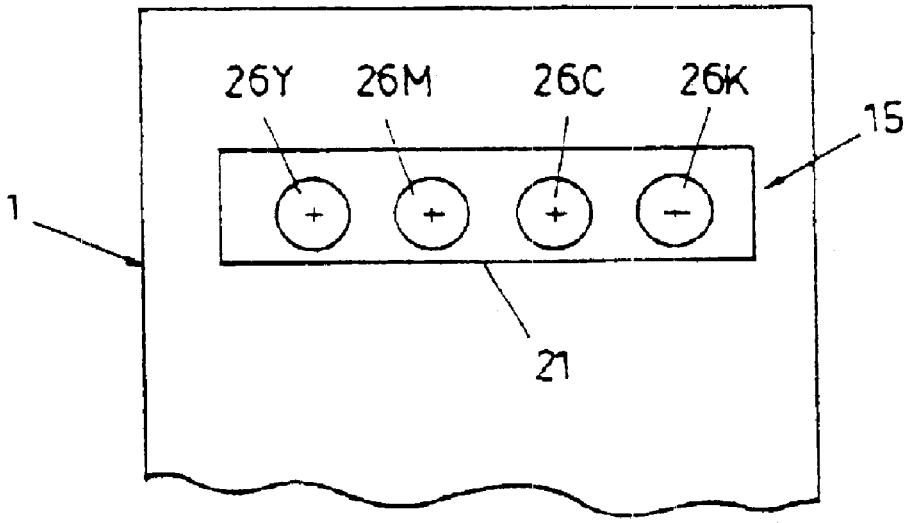
FIGS. 34, 35 and 36 each show a particular configuration of a removable drum unit.

FIG. 34 shows a specific configuration of a drum unit or photoconductive element unit removably mounted to the apparatus body 1. As shown, the drum unit, generally 15, includes a unit case 21 removably mounted to the apparatus body 1 and loaded only with the drums 26Y through 26K. The drums 26Y through 26K can therefore have their maximum eccentricity positions matched at opposite ends in the form of a unit, facilitating maintenance.

Figure 35:
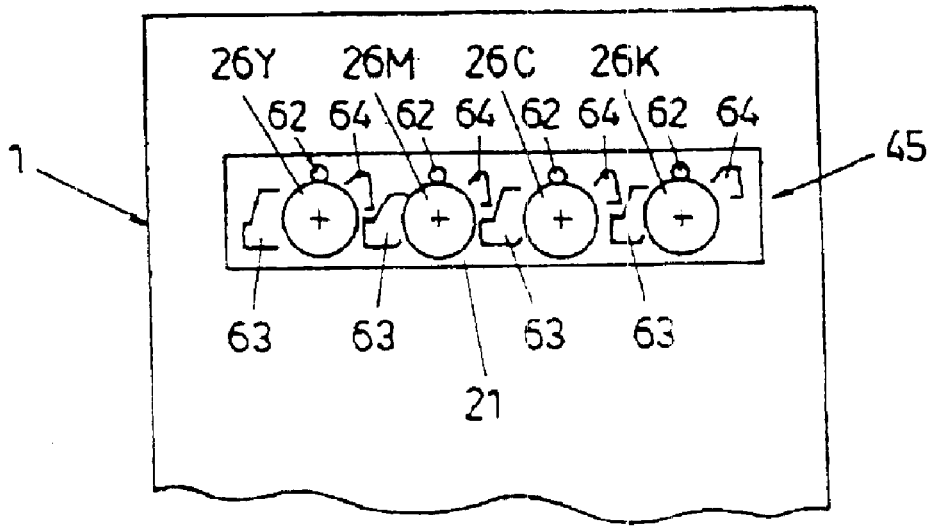

FIG. 35 shows another specific configuration the drum unit. In FIG. 35, structural elements identical with the structural elements of FIG. 34 are designated by identical reference numerals. As shown, a unit case 45 is loaded with the chargers 62, developing units 63 and cleaning units 64 in addition to the drums 26Y through 26K. However, it is not necessary to mount all of the chargers 62, developing units 63 and cleaning units 64 to the unit case 21.

Figure 36:
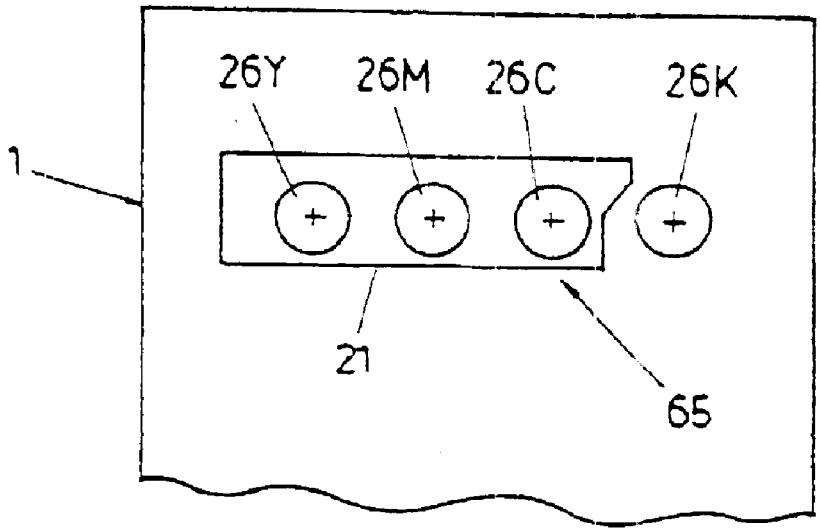

FIG. 36 shows still another specific configuration of the drum unit. As shown, the unit case 21 is loaded with the drums 26Y, 26M and 26C other than the drum 26K. The charges 62, developing units 63 and cleaning units 64, FIG. 35, may be mounted to the unit case 21 together with the drums 26Y, 26M and 26C, if desired. In this configuration, when the life of the drum 26K, which is used most frequency, ends, it can be replaced alone with the other drums 26Y, 26M and 26C being left on the unit case 21. This is desirable from the cost standpoint.

Figure 37:
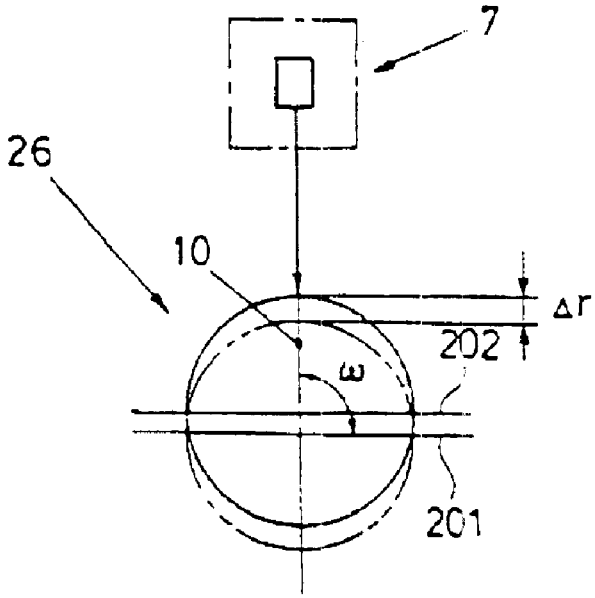
FIG. 37 is a front view showing one drum together with an optical writing unit.
Figure 38:
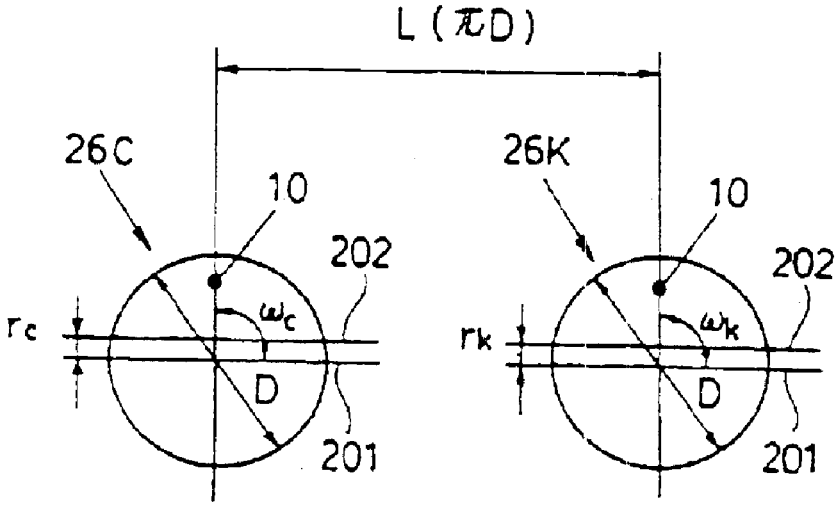
FIG. 38 is a front view showing a condition wherein the marks indicative of the maximum eccentricity positions of two drums assigned to cyan and black, respectively, are matched in phase to each other in the direction of rotation.

Hereinafter will be described an allowable error, or allowable irregularity in angle, between the drums to occur when the maximum eccentricity positions are matched in phase at each side of the drums. FIG. 37 is a front view showing one of the drums 26. FIG. 38 is a front view showing a specific condition wherein the marks 10 of the drums 26C and 26K indicative of the maximum eccentricity positions are matched in phase to each other in the direction of rotation.

Figure 39:
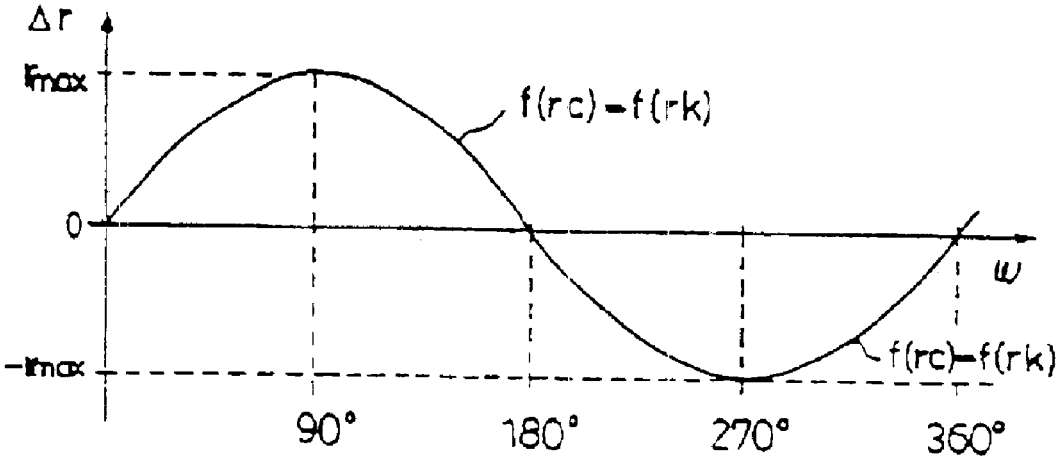
FIG. 39 shows curves f(rc) and f(rk) showing a relation between an angle ω and a distance Δr to hold when rc and rk are equal to each other.

As shown in FIGS. 37 and 38, assume that the angle between the horizontal and each mark 10 is ω, and that, when the drum 26 moves from an ideal axis 201 to the actual axis 202 due to eccentricity, the surface of the drum 26 moves toward the writing unit 7 by a distance of Δr. FIG. 39 shows a relation between the angle ω and the distance Δr. As FIG. 39 indicates, curves f(fc) and f(rk) derived from the drums 26C and 26K, respectively, are coincident with each other at every angle ω. Therefore, the eccentricity difference Δr' between the drums 26C and 26K is zero, meaning that a C and a K image are brought into accurate register.

Figure 40:
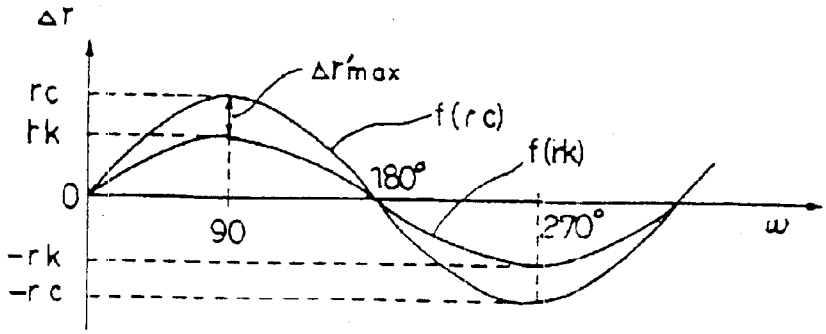
FIG. 40 shows the curves f(cr) and f(ck) appearing when rc is greater than rk.

As shown in FIG. 38, assume that the eccentricity of the drum 26C and that of the drum 26K are rc and rk, respectively, and that rc is greater than rk. FIG. 40 shows the curves f(rc) and f(ck) determined in the above condition. In this case, the eccentricity difference Δr' is produced by:

$$\Delta r' = f(rc) - f(rk)$$

The eccentricity difference Δr' has a maximum value Δr'max when the angle ωis 90° and 270°. Therefore, the positional shift Δx', FIG. 9, of an image and the maximum shift Δxmax at any angle are expressed as:

$$\Delta x' = \Delta r'/\tan\theta$$

$$\Delta x\max = \Delta r'\max/\tan\theta$$

Figure 41A:
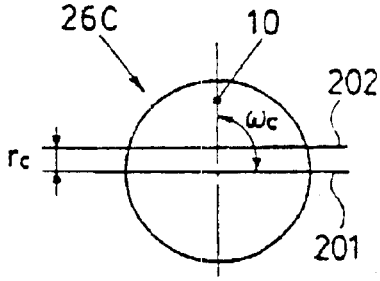
FIGS. 41A and 41B show a specific condition wherein the marks indicative of the maximum eccentricity positions of the cyan and black drums are shifted from each other in opposite directions.
Figure 41B:
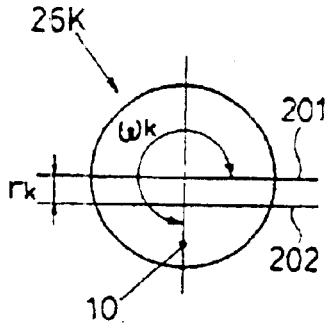
Figure 42:
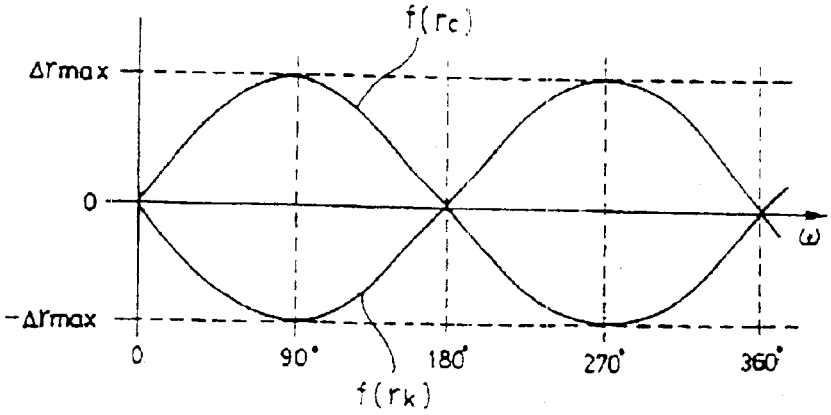
FIG. 42 shows curved f(cr) and f(ck) appearing when rc=rk=rmax holds in FIGS. 41A and 41B.
Figure 43:
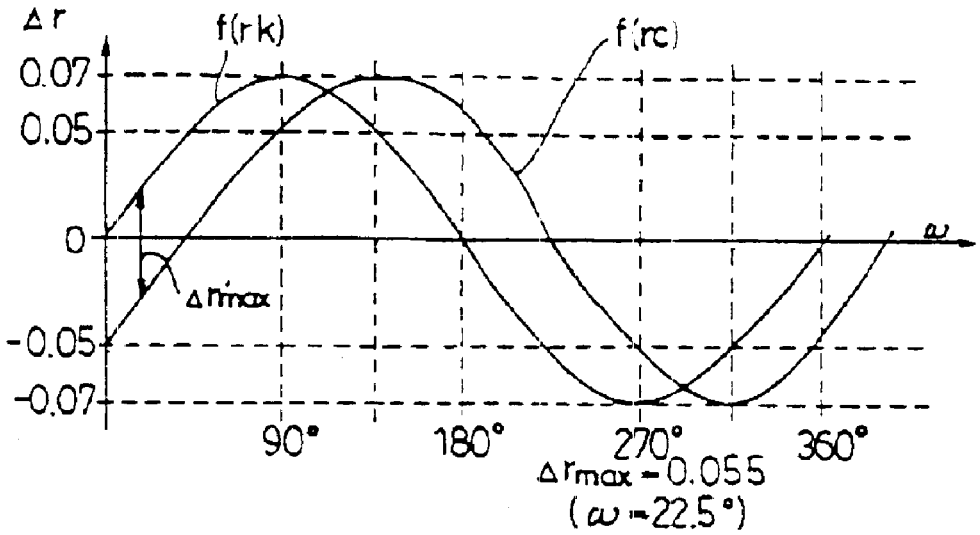
FIG. 43 shows curves for describing an allowable error included in the phase matching of the maximum eccentric positions in the direction of rotation.

As shown in FIGS. 41A and 41B, assume that the maximum eccentricity positions of the drums 26C and 26K are shifted from each other in opposite directions (ωk−ωc=180°). Then, assuming that the eccentricity rc of the drum 26C and that rk of the drum 26K are rc=rc=rmax, then f(rc) and f(rk) vary as shown in FIG. 42. In this case, the eccentricity difference Δr'max is produced by:

$$\Delta r'\max = 2\Delta r\max(\omega = 90°, 270°, \ldots)$$

As a result, there occurs between C and K a color shift produced by:

$$\Delta x\max = \Delta r'\max/\tan\theta\max$$
$$= 2\Delta r\max/\tan\theta\max$$

An allowable error, or allowable irregularity in angle, will be described hereinafter as to the matching of the maximum eccentricity positions of a plurality of drums in the direction of rotation. Assume a model in which there hold θmax=60° (see FIG. 1), Δrk=Δrc=0.07 and ωk−ωc=45°. Then, there hold the following equations:

$$\Delta r'\max \approx 0.055\ (\omega \approx 22.5°, 202.5°, \ldots)$$

$$\Delta x\max = \Delta r'\max/\tan\theta\max$$
$$= 0.055/\tan 60°$$
$$= 0.032\ \text{mm}$$

Figure 44:
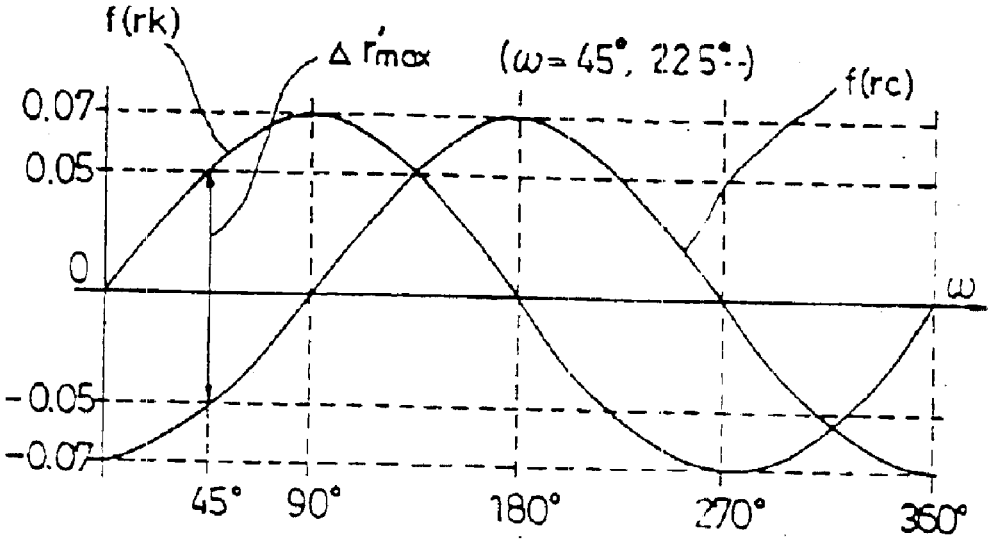
FIG. 44 shows the curves f(rc) and f(rk) appearing when the phases of the marks are varied.

FIG. 44 shows f(rk) and f(rc) to hold when only ωk−ωc=90° is varied under the above conditions. In this case, Δxmax is produced by:

$$\Delta r'\max \approx 0.1(\omega = 45°, 225°, \ldots)$$

$$\Delta x\max = 0.058\ \text{mm}$$

So long as Δxmax is 50 μm or less, a color shift is inconspicuous to eye, as stated earlier. However, in the case of ω=45°, 225° . . . , Δxmax amounts to about 60 μm and renders a color shift conspicuous. This undesirable condition can be coped with by making the angle that allows an angular error in phase between the maximum eccentricity positions of the drums smaller than 45°.

As stated above, a color image free from conspicuous color shifts is achievable if an angular error between the maximum eccentricity positions of the drum 76Y through 76K in the direction of rotation is smaller than 45°. It should be noted that the above angular error is made smaller than 45° only when Δmax=60°, Δrk=Δrc=0.07 and ωk−ωc=45° hold. Stated another way, the angular error, of course, varies when the above conditions are varied.

In summary, it will be seen that the present invention provides a photoconductive element unit for an image forming apparatus having various unprecedented advantages, as enumerated below.

(1) The maximum eccentricity positions of a plurality of photoconductive elements are matched in phase to each other in the direction of rotation. Therefore, even images formed by opposite end portions of one photoconductive element are free from shits from images of different colors formed by the other photoconductive elements and superposed thereon.

(2) It is not necessary to match the maximum eccentricity positions of opposite ends of each photoconductive element in phase in the direction of rotation. This obviates the need for sophisticated work for matching the eccentric positions of opposite support portions of the photoconductive element.

(3) Even when the actual axis of the photoconductive element is not parallel to an ideal axis due to eccentricity, the influence of a color shift ascribable to the eccentricity does not appear in an image.

(4) It is possible to make the number of motors smaller than the number of photoconductive elements and, in addition, to extend the life of drivelines assigned to color photoconductive elements.

Various modifications will become possible for those skilled in the art after receiving the teachings of the present disclosure without departing from the scope thereof.

What is claimed is:

1. An image forming apparatus comprising:

a plurality of photoconductive elements, at least one of said photoconductive elements comprising two support portions configured to adjust maximum eccentricity positions independently from one another, at least one of the two support portions comprising a tapered portion configured to support a corresponding tapered portion and to contact an interior surface opposite an image forming surface of the at least one photoconductive element.

2. The apparatus as claimed in claim 1, wherein said at least one photoconductive element comprises an element body rotatably supported at opposite ends in a main scanning direction by the two support portions, at least one of said support portions configured to be separated from said element body, the two support portions configured to permit the maximum eccentricity positions of said photoconductive elements to be matched in phase to each other in a direction of rotation at each of said support portions before being mounted to the element body.

3. An image forming apparatus comprising:

a plurality of photoconductive elements, at least one of said photoconductive elements comprising support portions configured to adjust maximum eccentricity positions independently from one another, and a plurality of motors, each of the motors configured to drive a different one of the photoconductive elements, wherein said photoconductive elements comprise an element body rotatably supported at opposite ends in a main scanning direction by support portions, at least one of said support portions configured to be separated from said element body, the support portions configured to permit the maximum eccentricity positions of said photoconductive elements to be matched in phase to each other in a direction of rotation at each of said support portions before being mounted to the element body.

4. The apparatus as claimed in claim 3, further comprising:

means for sensing marks indicative of the maximum eccentricity positions disposed on the support portions; and means for matching positions of the maximum eccentricity positions with one another based on an output of the means for sensing.

5. An image forming apparatus comprising:

a plurality of photoconductive elements arranged side by side, said plurality of photoconductive elements each configured to allow opposite end portions in a main scanning direction to be adjusted in a maximum eccentricity position in a direction of rotation independently of each other, the maximum eccentricity positions of said plurality of photoconductive elements capable of being matched in phase to each other in said direction of rotation at each of opposite end portions, wherein said plurality of photoconductive elements each comprise an element body formed with support portions rotatably supported at opposite ends in the main scanning direction, at least one of said support portions configured to be separated from said element body, the support portions configured to permit the maximum eccentricity positions of said plurality of photoconductive elements to be matched in phase to each other in the direction of rotation at each of said support portions before being mounted to the element body such that said maximum eccentricity positions of said plurality of photoconductive elements are matched in phase to each other in said direction of rotation, and wherein one of said photoconductive elements is driven by a first motor, the other photoconductive elements are driven by a second motor with the maximum eccentricity positions thereof at opposite end portions in the main scanning direction being matched in phase at each of said opposite end portions, maximum eccentricity sensing means senses a mark indicative of the maximum eccentricity positions on either one of the end portions of said photoconductive element driven by said first motor and a plurality of maximum eccentricity sensing means sense marks indicative of the maximum eccentricity positions on either one of the end portions of the other photoconductive elements driven by said second motor, and in a mode for forming an image by using said photoconductive eccentricity driven by said first motor and said photoconductive elements driven by said second motor, the marks on said photoconductive elements are sensed by said maximum eccentricity sensing means and matched in position to each other in the direction of rotation.

6. The apparatus as claimed in claim 5, wherein said photoconductive element driven by said first motor is configured to form a black image and said photoconductive elements driven by said second motor are configured to form a non-black image.

7. An image forming apparatus comprising:

a plurality of photoconductive elements, at least one of said photoconductive elements comprising support portions configured to adjust maximum eccentricity positions independently from one another, and at least one clutch configured to output torque of at least one motor to a least one of the photoconductive elements, wherein said photoconductive elements comprise an element body rotatably supported at opposite ends in a main scanning direction by support portions, at least one of said support portions configured to be separated from said element body, the support portions configured to permit the maximum eccentricity positions of said photoconductive elements to be matched in phase to each other in a direction of rotation at each of said support portions before being mounted to the element body.

8. An image forming apparatus comprising:

a plurality of photoconductive elements, at least one of said photoconductive elements comprising support portions configured to adjust maximum eccentricity positions independently from one another, and a motor configured to directly drive one of the photoconductive element and to drive the other photoconductive elements through a clutch, wherein said photoconductive elements comprise an element body rotatably supported at opposite ends in a main scanning direction by support portions, at least one of said support portions configured to be separated from said element body, the support portions configured to permit the maximum eccentricity positions of said photoconductive element to be matched in phase to each other in a direction of rotation at each of said support portions before being mounted to the element body.

9. The apparatus as claimed in claim 8, wherein said photoconductive element configured to be directly driven by said motor is configured to form a black image.

10. An image forming apparatus comprising:

a plurality of photoconductive elements arranged side by side, said plurality of photoconductive elements each configured to allow opposite end portions in a main scanning direction to be adjusted in a maximum eccentricity position in a direction of rotation independently of each other, the maximum eccentricity positions of said plurality of photoconductive elements capable of being matched in phase to each other in said direction of rotation at each of opposite end portions, wherein said plurality of photoconductive elements each comprise an element body formed with support portions rotatably supported at opposite ends in the main scanning direction, at least one of said support portions configured to be separated from said element body, the support portions configured to permit the maximum eccentricity positions of said plurality of photoconductive elements to be matched in phase to each other in the direction of rotation at each of said support portions before being mounted to the element body such that said maximum eccentricity positions of said plurality of photoconductive elements are matched in phase to each other in said direction of rotation, and wherein said support portions of each of said plurality of photoconductive elements comprise flanges mounted on a shaft at centers of the flanges, and wherein at least one of the support portions comprises a tapered portion configured to support a corresponding tapered portion and to contact an interior surface opposite an image forming surface of at least one of the photoconductive elements.

11. The apparatus as claimed in claim 10, wherein the maximum eccentric position comprises a position most shifted from an axis of said shaft on which said flanges are mounted.

12. The apparatus as claimed in claim 10, wherein said flanges comprise resin.

13. The apparatus as claimed in claim 2, wherein photoconductive elements are disposed a distance from one another equal to a circumferential length of a surface of said photoconductive elements.

14. An image forming apparatus comprising:

a plurality of photoconductive elements, at least one of said photoconductive elements comprising support portions configured to adjust maximum eccentricity positions independently from one another, and a plurality of motors, each of the motors configured to drive a different one of the photoconductive elements.

15. The apparatus as claimed in claim 14, further comprising:

means for sensing marks indicative of the maximum eccentricity positions disposed on the support portions; and means for matching positions of the maximum eccentricity positions with one another based on an output of the means for sensing.

16. The apparatus as claimed in claim 14, wherein said photoconductive elements are disposed a distance from one another equal to a circumferential length of a surface of said photoconductive elements.

17. An image forming apparatus comprising:

a plurality of photoconductive elements, at least one of said photoconductive elements comprising support portions configured to adjust maximum eccentricity positions independently from one another;

a first motor configured to drive one of the photoconductive elements; and a second motor configured to drive the other photoconductive elements.

18. An image forming apparatus comprising:

a plurality of photoconductive elements arranged side by side, said plurality of photoconductive elements each configured to allow opposite end portions in a main scanning direction to be adjusted in a maximum eccentricity position in a direction of rotation independently of each other, the maximum eccentricity positions of said plurality of photoconductive elements capable of being matched in phase to each other in said direction of rotation at each of opposite end portions, wherein one of said plurality of photoconductive elements is driven by a single exclusive motor while the other photoconductive elements are driven by a single shared motor, and wherein said photoconductive element driven by said exclusive motor as a smallest eccentricity, and the other photoconductive elements driven by said shared motor have the maximum eccentricity positions matched in phase to each other in the direction of rotation at each of opposite ends.

19. The apparatus as claimed in claim 18, wherein said photoconductive elements comprise an element body rotatably supported at opposite ends in the main scanning direction by support portions, at least one of said support portions configured to be separated from said element body, the support portions configured to permit the maximum eccentricity positions of said photoconductive elements driven by said shared motor to be matched in phase to each other at each of said support portions positioned at one end and said support portions positioned at the other end in the direction of rotation before being mounted to the element bodies.

20. The apparatus as claimed in claim 19, wherein said support portions of said photoconductive elements comprise flanges mounted on a shaft at centers of the flanges.

21. The apparatus as claimed in claim 20, wherein the maximum eccentric position comprises a position most shifted from an axis of said shaft on which said flanges are mounted.

22. The apparatus as claimed in claim 20, wherein said flanges comprise resin.

23. The apparatus as claimed in claim 17, wherein said photoconductive elements are disposed a distance from one another equal to a circumferential length of a surface of said photoconductive elements.

24. An image forming apparatus comprising:

a plurality of photoconductive elements arranged side by side, said plurality of photoconductive elements each configured to allow opposite end portions in a main scanning direction to be adjusted in a maximum eccentricity position in a direction of rotation independently of each other, the maximum eccentricity positions of said plurality of photoconductive elements capable of being matched in phase to each other in said direction of rotation at each of opposite end portions, wherein one of said plurality of photoconductive elements is driven by first motor, the other photoconductive elements are driven by a second motor with the maximum eccentricity positions thereof at opposite end portions in the main scanning direction being matched in phase at each of said opposite end portions, maximum eccentricity sensing means senses a mark indicative of the maximum eccentricity positions on either one the end portions of said photoconductive element driven by said first motor and a plurality of maximum eccentricity sensing means sense marks indicative of the maximum centricity positions on either one of the end portions of the other photoconductive elements driven by said second motor, and in a mode for forming an image by using said photoconductive element driven by said first motor and said photoconductive elements driven by said second motor, the marks on said photoconductive elements are sensed by said maximum eccentricity sensing means and matched in position to each other in the direction of rotation.

25. The apparatus as claimed in claim 24, wherein said photoconductive element driven by said first motor is configured to form a black image and said photoconductive elements driven by said second motor are configured to form a non-black image.

26. The apparatus as claimed in claim 24, wherein said photoconductive elements are disposed a distance from one another equal to a circumferential length of a surface of said photoconductive elements.

27. An image forming apparatus comprising:

a plurality of photoconductive elements, at least one of said photoconductive elements comprising support portions configured to adjust maximum eccentricity positions independently from one another, and at least one clutch configured to output torque of at least one motor to least one of the photoconductive elements.

28. The apparatus as claimed in claim 27, wherein said photoconductive elements are disposed a distance from one another equal to a circumferential length of a surface of said photoconductive elements.

29. An image forming apparatus comprising:

a plurality of photoconductive elements, at least one of said photoconductive elements comprising support portions configured to adjust maximum eccentricity positions independently from one another, and a motor configured to directly drive one of the photoconductive element and to drive the other photoconductive elements through a clutch.

30. The apparatus as claimed in claim 29, wherein said photoconductive element configured to be directly driven by said motor is configured to form a black image.

31. The apparatus as claimed in claim 29, wherein said photoconductive elements are disposed a distance from one another equal to a circumferential length of a surface of said photoconductive elements.

32. The apparatus as claimed in claim 1, wherein said photoconductive elements are disposed a distance from one another equal to a circumferential length of a surface of photoconductive elements.

33. An image forming apparatus comprising:

an apparatus body;

a unit case removably disposed in the apparatus body; and a plurality of photoconductive elements arranged in the unit case, at least one of said photoconductive elements comprising two support portions configured to adjust maximum eccentricity positions independently from one another, at least one of the two support portions comprising a tapered portion configured to support a corresponding tapered portion and to contact an interior surface opposite an image forming surface of the at least one photoconductive element.

34. An image forming apparatus comprising:

an apparatus body;

a unit case removably disposed in the apparatus body; and first and second photoconductive elements, the first photoconductive elements arranged in the unit case, the first photoconductive element comprising two support portions configured to adjust maximum eccentricity positions independently from one another, at least one of the two support portions comprising a tapered portion configured to support a corresponding tapered portion and to contact an interior surface opposite an image forming surface of the first photoconductive element.

35. The image forming apparatus as claimed in claim 34, wherein said second photoconductive element is configured to form a black image.

36. A photoconductive element configured to be mounted to an apparatus body of an image forming apparatus together with other photoconductive elements, the photoconductive element comprising:

first and second support portions configured to adjust maximum eccentricity positions independently from one another, the first support portion comprising a tapered portion configured to support a corresponding tapered portion and to contact an interior surface opposite an image forming surface of the photoconductive element.

* * * * *